US006902518B2

(12) United States Patent
Bretl

(10) Patent No.: US 6,902,518 B2
(45) Date of Patent: Jun. 7, 2005

(54) CARD PACKAGE PRODUCTION SYSTEM WITH ADHESIVE CARD ATTACHMENT STATION AND METHOD

(75) Inventor: Robert J. Bretl, Menominee, MI (US)

(73) Assignee: Dynetics Engineering Corporation, Inc., Lincolnshire, IL (US)

( * ) Notice: Subject to any disclaimer, the term of this patent is extended or adjusted under 35 U.S.C. 154(b) by 108 days.

(21) Appl. No.: 10/257,613

(22) PCT Filed: Feb. 22, 2001

(86) PCT No.: PCT/US01/06159

§ 371 (c)(1),
(2), (4) Date: Oct. 15, 2002

(87) PCT Pub. No.: WO01/62485

PCT Pub. Date: Aug. 30, 2001

(65) Prior Publication Data

US 2003/0207744 A1 Nov. 6, 2003

Related U.S. Application Data

(60) Provisional application No. 60/184,443, filed on Feb. 23, 2000.

(51) Int. Cl.[7] ..... B31B 1/90

(52) U.S. Cl. ..... 493/375; 493/961; 493/376; 493/210; 156/249; 156/230; 156/308.2; 156/309.9; 53/117; 53/569

(58) Field of Search ..... 493/210, 374, 493/379, 382, 78, 961, 375, 451, 442, 436, 417, 144, 189, 191; 156/289, 249, 238, 302.8, 309.9, 297, 299, 302, 320, 308.2; 53/569, 117, 284.3

(56) References Cited

U.S. PATENT DOCUMENTS

| | | | | |
|---|---|---|---|---|
| 3,572,682 A | | 3/1971 | Leach et al. | |
| 3,735,095 A | | 5/1973 | Mutz et al. | |
| 4,326,704 A | * | 4/1982 | Barr | 270/52.13 |
| 4,848,066 A | * | 7/1989 | Luhman | 53/485 |
| 5,082,268 A | * | 1/1992 | Santoro | 271/14 |
| 5,388,815 A | * | 2/1995 | Hill et al. | 270/32 |
| 5,403,236 A | * | 4/1995 | Greig | 462/6 |
| 5,701,727 A | | 12/1997 | Lundstrom et al. | |

* cited by examiner

*Primary Examiner*—Rinaldi I. Rada
*Assistant Examiner*—Thanh Truong
(74) *Attorney, Agent, or Firm*—James W. Potthast; Potthast & Associates

(57) ABSTRACT

A card package production system (100) for producing card packages (115) composed of cards (128) attached to carriers (113) has an adhesive label attachment station (358, FIG. 34) with a heating platen (361) having a width for heating at least two labels (148) simultaneously that are passed over the platen (361) and a labeler downstream from the heating platen (361) with a pressing member (372) for pressing the heated adhesive label (128) against a card (128) at an attachment position. The heating platen (361) heats only an intermediate section of the adhesive to activate the adhesive and leaves end portions of the label relatively unheated and unactivated to facilitate subsequent removal of the label (148) from the card (128).

26 Claims, 35 Drawing Sheets

Fig.50C

UPPER 1A - MOTOR CONTROL (BD 1)
1. GND
2. CARD PICK - LEFT (GN)
3. GND
4. CARD PICK - RIGHT (GN)
5. GND
6. CARD PUSHER - FORWARD (PU)
7. GND
8. CARD PUSHER - REVERSE (BL)

UPPER 2A - QUADRATURE ENCODER
1. 5VDC
2. CARD SHUTTLE ENCODER -5 (BL)
3. 5VDC
4. CARD SHUTTLE ENCODER - 3(YL)
5. 5VDC
6. FORM POSITION ENCODER - 5 (YL)
7. 5VDC
8. FORM POSITION ENCODER - 3 (BL)

UPPER 3A - ANALOG INPUT (CARD QTY PATS)
1. CABEL 6 - WIRE 5 (CENTER) (WH/OR)
2. UPPER 3B - POS 2 (BK)
3.
4.
5. CABEL 6 - WIRE (RIGHT) (OR/WH)
6. GND (BK)
7.
8.

LOWER 1A - HEATER
1. 110VAC (BK)
2. HEATER (BK)
3.
4.
5.
6.
7.
8.

LOWER 2A - PHANTOM MODULE
1.
2.
3.
4.
5.
6.
7.
8.

UPPER 1B - SENSOR BOARD 1/CABEL 1
1. 5VDC
2. CARD GRIP - LEFT (HOPPER) (OR/WH)
3. 5VDC
4. CARD GRIP - RIGHT (HOPPER) (WH/OR)
5. 5VDC
6. CARDS IN HOPPER - LEFT (GN/WH)
7. 5VDC
8. CARDS IN HOPPER - RIGHT (WH/GN)

UPPER 2B - MOTOR CONTROL (BD 1)
1. GND
2. CARD SHUTTLE - FORWARD (WH)
3. GND
4. CARD SHUTTLE - REVERSE (GY)
5. GND
6. FORM POSITION - FORWARD (YL)
7. GND
8. FORM POSITION - REVERSE (OR)

UPPER 3B - ANALOG INPUT (CARD QTY PATS)
1. CABEL 6 - WIRE 4 (LEFT) (GN/WH)
2. UPPER 3A - POS 2 (BK)
3.
4.
5.
6. GND (BK)
7.
8.

LOWER 1B - THERMOCOUPLE
1. THERMOCOUPLE (WH)
2. THERMOCOUPLE GND
3.
4.
5.
6.
7.
8.

LOWER 2B - SOLENOID DRIVER
1. GND (BL)
2. CARD DROP - TRACK (RD)
3. GND
4. STACKER SOLENOID (RD)
5. GND
6. STACKER REJECT (RD)
7. GND
8.

UPPER 1C - SENSOR BOARD 2/CABEL 2
1. 5VDC
2. CARD LABELING POSITION (OR/WH)
3. 5VDC
4. CARD READING POSITION (WH/OR)
5. 5VDC
6. CARD PUSHER HOME - LEFT (GN/WH)
7. 5VDC
8. CARD PUSHER HOME - RIGHT (WH/GN)

UPPER 2C - MOTOR CONTROL (BD 1)
1. GND
2. LABEL ADVANCE (BN)
3. GND
4. LABEL APPLY (RD)
5. GND
6.
7. GND
8.

LOWER 1C - SENSOR BOARD 4 / CABEL 4
1. 5VDC
2. FORM AT POSITION - A (OR)
3. 5VDC
4. FORM AT POSITION - B (LOWER) (WH/OR)
5. 5VDC
6.
7. 5VDC (RD)
8.

LOWER 2C - SENSOR BOARD 5 / CABEL 5
1. 5VDC
2. FORM AT STACKER (OR/WH)
3. 5VDC
4. HOPPER HOME (WH/OR)
5. 5VDC
6. HOPPER FULL (GN/WH)
7. 5VDC
8. FORM AT POSITION - D (UPPER)

UPPER 1D - SENSOR BOARD 3 / CABEL 3
1. 5VDC
2. SHUTTLE - CARD PRESENT (OR/WH)
3. 5VDC
4. SHUTTLE - HOME (WH/OR)
5. 5VDC
6. CARD PUSHER - AWAY (GN/WH)
7. 5VDC
8.

UPPER 2D - SENSOR BOARD 4 / CABEL 4
1. 5VDC
2. LABEL APPLY - HOME (WH/GN)
3. 5VDC
4. FORM AT POSITION - B (UPPER) (WH/OR)
5. 5VDC
6. FORM AT POSITION -C (GN)
7. 5VDC
8. LABEL POSITION SENSOR (WH)

UPPER 2C - MOTOR CONTROL (BD D)
1. GND
2. FEED MOTOR - B (BL)
3. GND
4. FEED MOTOR - A (YL)
5. GND
6.
7. GND
8.

LOWER 2D - MOTOR CONTROL (BD 2)
1. GND
2. STACKER MOTOR (BN)
3. GND
4. HOPPER MOTOR (PU)
5. GND
6.
7. GND
8. FEED MOTOR - D (GN)

CARD PACKAGE PRODUCTION SYSTEM WITH ADHESIVE CARD ATTACHMENT STATION AND METHOD

CROSS REFERENCE TO RELATED APPLICATION

This application claims under 35 U.S.C. 119(e) the benefit of U.S. Provisional Application No. 60/184,443, filed Feb. 23, 2000, and entitled "Card Package Production System and Method", and assigned to the assignee of the present application.

BACKGROUND OF THE INVENTION

1. Field of the Invention

This invention generally relates to card package production systems of the type that automatically produce card packages of cards, such as credit cards, to matching carrier forms for mailing, and more particularly to a mechanism and method for attaching the cards to the carriers through use of adhesive labels.

2. Description of the Prior Art

Card package production systems that produce card packages comprised of cards, such as plastic credit or debit cards, to matching paper carriers that bear printed information including the card owner's name and address in a location for viewing through a window envelope into which the carrier packages are ultimately inserted, or "stuffed", for mailing to the owner.

In some card package production systems the cards are mechanically attached to the carriers by means of die cut slots while in others the cards are directly adhered to the carriers by adhesive or by means of double-sided adhesive pads. In some systems, the cards, the carriers or both are produced by the system before attachment. In others, the cards or the carriers are provided to the system in a pre-prepared condition. In either event, in known systems the card and carriers travel unidirectionally towards each other and meet at an attaching or insertion station at which the cards are actually attached to the matching carriers, and the loaded carriers pass to a folding station at which the loaded carriers are folded before completion and insertion into an envelope.

Examples of such card package production systems in which the cards are mechanically attached to the carriers are shown in U.S. patent application Ser. No. 09/081,312, filed May 19, 1998, of Bretl et al. and entitled "Card Package Production System with a Multireader Card Track and Method", and in U.S. Pat. No. 5,494,544 issued Feb. 27, 1996 to Hill et al. and entitled "Automatic Verified Embossed Card Package Production Methods"; U.S. Pat. No. 5,541,395 issued Jul. 30, 1996 to Hill et al. and entitled "Card Package Production System with Burster and Code Reader"; U.S. Pat. No. 5,388,815 issued Feb. 14, 1995 to Hill et al. and entitled, "Embossed Card Package Production System with Modular Inserters for Multiple Forms"; U.S. Pat. No. 5,509,886 issued Apr. 23, 1996 to Hill et al. for "Card Package Production System with Modular Carrier Folding Apparatus for Multiple Forms"; and U.S. Pat. No. 5,433,364 issued Jul. 18, 1995 to Hill et al. for "Card Package Production System with Burster and Carrier Verification Apparatus", all assigned to the assignee of the present invention, and all of which together with the references cited therein are hereby incorporated by reference.

While mechanical attachment mechanisms are successful, they are capable of being readily separated from the carrier.

A problem with cards that are adhered directly to the carriers is that they cannot be easily removed and sometime the adhesive sticks to the card after removal from the carrier.

While double-sided adhesive labels, or pads, overcome the problem of adhesive sticking to the card after removal they are generally believed to be not as secure. It is of the utmost importance that the cards are adhered to the carriers sufficiently to prevent their separation during further processing. In addition, the card should remain attached to the carrier when the card and carrier are removed from an envelope by the ultimate user of the card upon receipt in the mail until it is intentionally removed. A card package production system in which the cards are attached by means of a double-sided adhesive label or pad is shown in U.S. Pat. No. 5,896,725 issued to Lundstrom et al.

In the known card package production system that employs use of double-sided adhesive labels to attach the cards to the carriers, the cards can be selectively placed at different locations on the carrier this is accomplished by means of an attachment apparatus that requires multidirectional movement by a card attachment mechanism in addition to unidirectional movement the carriers.

SUMMARY OF THE INVENTION

In accordance with the present invention a card package production system is provided in which the cards are attached to the matching carriers by means of adhesive pads that are securely fashioned to the carriers and the cards and in which both the carriers and the cards are required to move only along one direction.

This objective is achieved by providing a card package production system for producing card packages with printed paper carriers with matching cards attached by adhesive to the carriers with an adhesive label attachment station having a supply of double sided adhesive labels adhered to a roll of backing paper, one side of the labels against the backing paper having a permanent adhesive and the other side facing away from the backing paper having a heat activated adhesive, a heating platen with a width for heating at least two labels simultaneously, a label attachment position, a card transport for moving the cards to the card attachment position, a label transport system for passing the labels over the platen, a labeler downstream from the heating platen with a pressing member for pressing a heated adhesive label against a card at the attachment position by pressing against a side of the backing paper opposite the heated adhesive label.

Preferably, the label pressing member has an eccentric shape and is mounted for rotation into engagement with the backing tape. A counter member holds the card against force from the pressing member and is mounted rocking movement relative to the card. The counter member is located above the card, and the pressing member presses the adhesive labels upwardly toward the counter member. Also, the counter member is removeably mounted to a pivot post about which the counter member rocks, and the rocking movement is about an axis parallel to an axis of rotation of the eccentric member. The card is transported along a track in a horizontal position past the counter member.

The platen is maintained at an average temperature of no less than approximately 210 degrees Fahrenheit and the labels are engaged with the platen for no less than 100 milliseconds. Then the pressing member presses the label against the card within no less than approximately 100 milliseconds after being heated.

The objective of the invention is also obtained in part by providing in a card package production system for producing card packages with printed paper carriers with matching cards attached by adhesive to the carriers, an adhesive label attaching method comprising the steps of providing a supply of double sided adhesive labels adhered to a roll of backing paper, one side of the labels against the backing paper having a permanent adhesive and the other side facing away from the backing paper having a heat activated adhesive, heating at least two labels simultaneously with a heating platen, moving the cards a card transport for to a card attachment position, passing the labels over the platen with a label transport system, pressing, with a pressing member of a labeler located downstream from the heating platen, a heated adhesive label against a card at the attachment position by pressing against a side of the backing paper opposite the heated adhesive label.

The objective of the invention is also partly achieved by providing a card package production system for producing card packages with printed paper carriers with matching cards attached to the carriers with adhesive with an adhesive label attachment mechanism, having means for providing double sided adhesive labels on a roll of backing tape to an adhesive label attachment station, means for heating only an intermediate section of the adhesive to activate a heat activated adhesive carried by an outer side of the adhesive label, leaving end portions of the label relatively unheated and unactivated, and means for pressing the intermediate section of the adhesive after heating to a card.

Further, the objective is obtained in part by providing a in a card package production system for producing card packages with printed paper carriers with matching cards attached to the carriers with adhesive, method of attaching an adhesive label to the card, by performing the steps of providing double sided adhesive labels on a roll of backing tape to an adhesive label attachment station, heating only an intermediate section of the adhesive to activate a heat activated adhesive carried by an outer side of the adhesive label, leaving end portions of the label relatively unheated and unactivated, and pressing the intermediate section of the adhesive after heating to a card.

BRIEF DESCRIPTION OF THE DRAWINGS

The forgoing advantages and objectives will be described in detail and others will be made apparent in the detailed description of the best mode of practicing the present invention which is given below with reference to the several views of the drawing, in which:

FIG. 50C is a chart showing all of the connections of the control modules of FIG. 50A and FIG. 50B to the various sensors and motors that make up the control system;

FIGS. 51–60B are all special programming flow charts of the controller made pursuant to the protocols and procedures specified by OPTOCONTROL to operate the control module, controller board and brain board of the controller of FIGS. 50A, 50B and 50C;

FIG. 51 is a flow chart of the power up routine of the preferred embodiment;

FIG. 53 is a flow chart of the card label routine of the preferred embodiment;

FIG. 54 is a flow chart of the card push routine of the preferred embodiment;

FIG. 55 is a flow chart of the form feed C routine of the preferred embodiment;

FIG. 56 is a flow chart of the form feed D routine of the preferred embodiment;

FIG. 57 is a flow chart of the heater routine of the preferred embodiment;

FIG. 58 is a flow chart of the card picker mechanism Routine of the preferred embodiment;

FIG. 60 is a generic flow chart illustrating the operation for sensing the numbers of cards in each card package and rejecting card packages if the correct number of cards preselected for each designated location are not present in the carrier.

DETAILED DESCRIPTION

Figure 1:
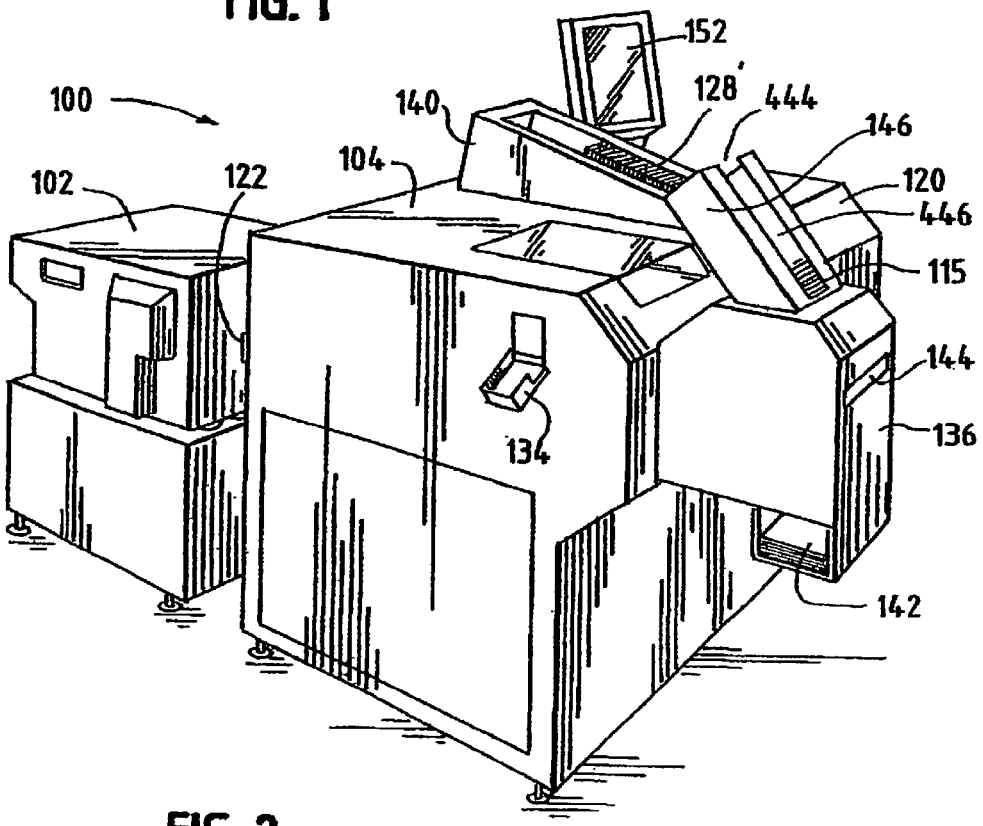
FIG. 1 is a perspective view of the card package production system of the present invention.
Figure 2:
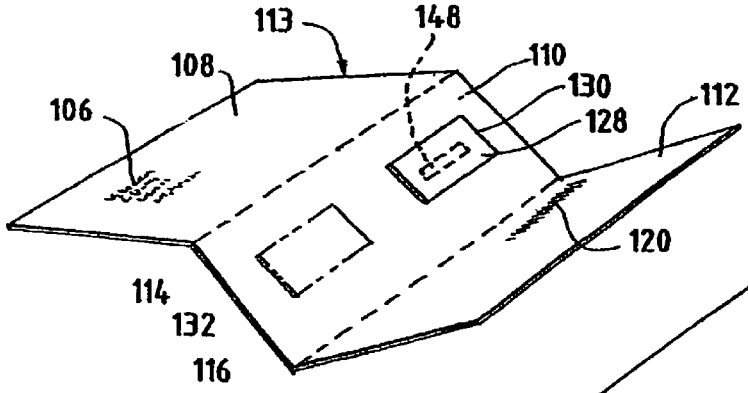
FIG. 2 is a perspective of a card package of the type produced by the card package production system of FIG. 1 with the card attached to the carrier.

Referring to FIG. 1, the preferred embodiment of the card package production system printer 100 of the present invention is seen to include a free standing printer module 102 and a card attachment module 104. Referring to FIG. 2, the printer module prints card holder name and address and other account information 106, on one of three panels 108, 110 and 112 of a paper sheet carrier 113, such as the middle panel 110. The three panels are defined by two pre-weakened fold-lines 114 and 116. The printer module also prints a bar code 120 representative of information concerning the account on another of the panels, such as the end panel 112, such as the account number and the number of cards that are to be attached to the carrier 113. The printer module is controlled by a computer (not shown)and controller, described below. The printer preferably prints carriers at a minimum speed of 32/minute and has a resolution of no less than 300 dpi×300 dpi. The normal speed of operation is approximately 2000 carriers per hour, or approximately thirty-three carriers per minute. The printer module 102 is preferably a model PLAY PLEX printer made by OLYMPUS, or equivalent. The details of the printer module form no part of the present invention but reference may be made to operator's guide for the above identified model MS32NSS published by OLYMPUS.

Figure 6:
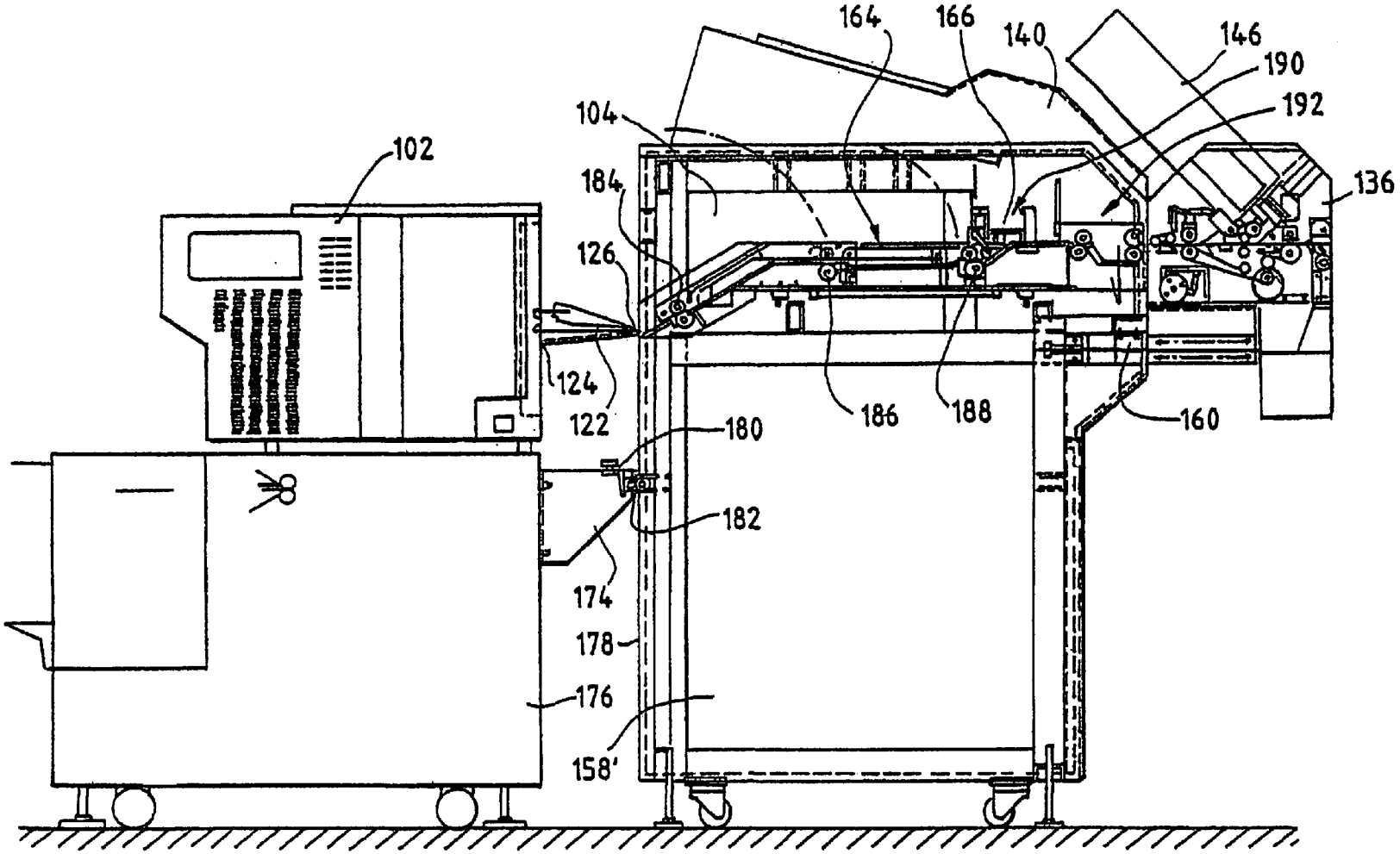
FIG. 6 is a side elevational view of the card package production system of FIG. 1 with portions of the card attachment module broken away to show selected internal features.
Figure 7:
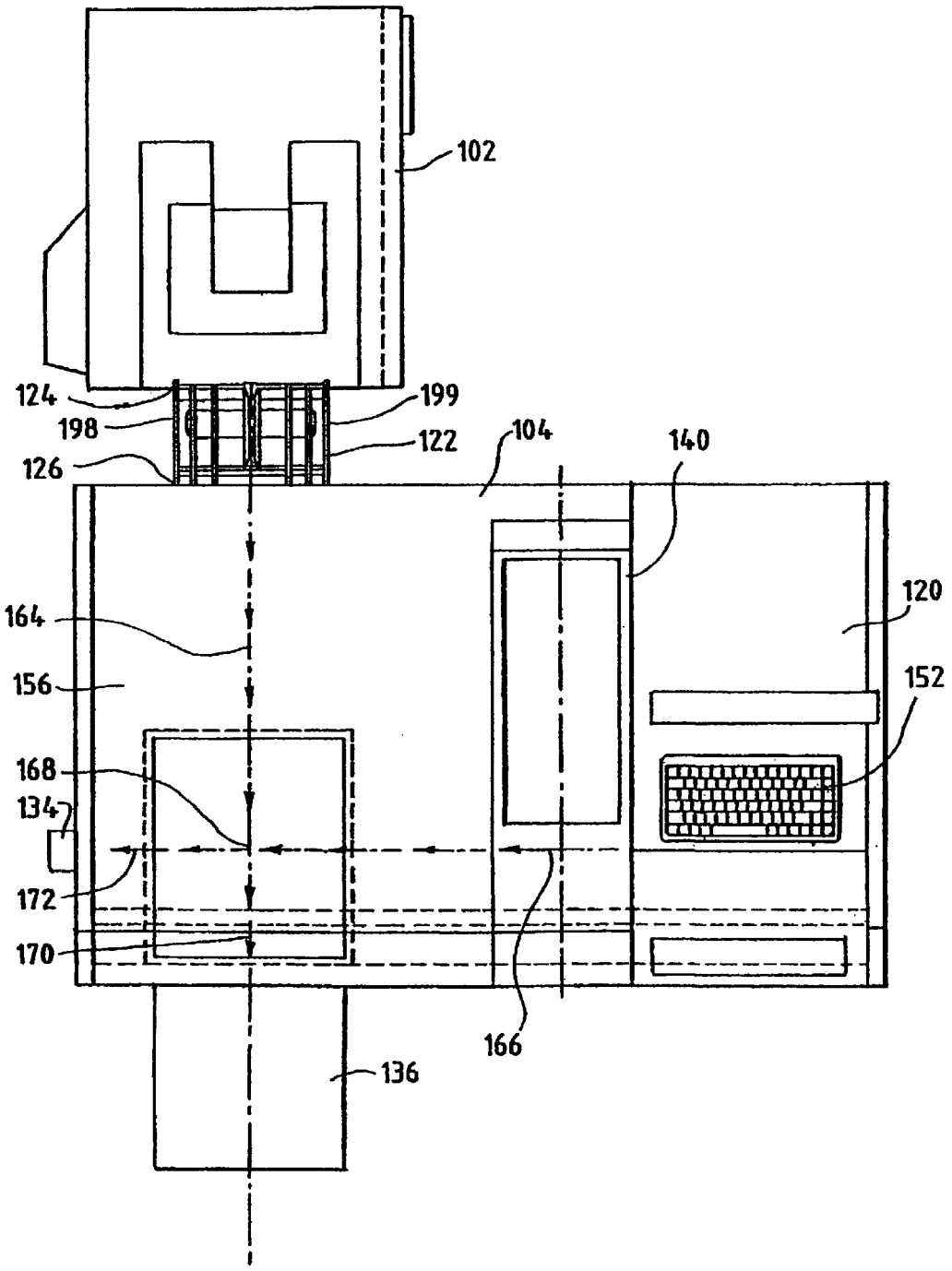
FIG. 7 is a plan view of the card package production system of FIG. 1.

The operation is described pursuant to the example of the card holder information 106 being located on panel 108 and the bar code 120 being mounted at the location shown on panel 112. However, the PRINTER is capable of printing both the card holder information 106 and the bar code information 120 at other selected locations on the carrier 113. The card attachment module 104 is capable of reading the information at other informational locations on the carrier 113 than the example shown in FIG. 2. The printed carriers 113 from the printing module 102 are passed to the attachment module 104 by means of an inter-module carrier guide 122. The inter-module carrier guide is better seen in FIG. 7, and is described in detail with reference to FIGS. 8–10. Referring to FIGS. 6 and 7, the guide 122 passes carriers 113 from an outlet 124 of the carrier printer module 102 to a carrier inlet 126 of the attachment module 104.

Figure 3:
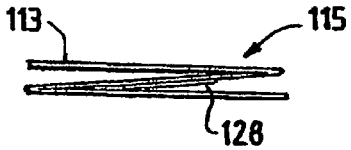
FIG. 3 is a an end view of the card package of FIG. 2 in a folded state ready for mailing.

Referring again to FIGS. 1 and 2, the attachment module takes cards from a stack of pre-embossed cards 128' from a card picker assembly 140 and attaches cards 128, such as embossed and/or magnetically encoded credit cards, encoded chip cards, R/F cards, etc. to the carrier 113 at one or more locations 130 and 132 or on like locations on one or more or all of the three panels. It then folds the carrier, as shown in FIG. 3, to form a card package 115.

The details of the card picker assembly forms no part of the present invention, and preferably is substantially the same as the one shown in U.S. patent application of Bretl et al., Ser. No. 09/081,312, filed May 19, 1998, and entitled "Card package Production System With a Multireader Card Track and Method", which is hereby incorporated by reference.

The cards 128 generally have an account number and an account holder's name embossed on the card and the same information encoded on a magnetic stripe on the back of the card 128. Additional information, such as the number of cards to be attached to the carrier may also be contained in the bar code. In addition, the back of the card has the account number and account name encoded in bar code printed on the back of the card. This information is checked for proper encoding and if the coding is not correct or if the coding does not match the encoded information of a carrier to which it is to be attached, the card 128 is passed through the attachment module 104 to a card reject bin 134.

Other wise the cards 128 are attached to the matching carrier 113 to form the card package 115, and the card packages 115 are passed to a card package distribution module 136 for distribution in three different ways depending upon circumstances. In one case, if the card packages 115 are unacceptable due to having too many cards, not enough cards or cards in the wrong location, then they are passed to a card package reject bin 142. If the card package is correctly prepared and is to be passed directly to an envelope stuffing machine (not shown), such as a model SERIES 5 envelope stuffer made by PITNEY BOEWES, then the card packages are passed directly to the envelope stuffer through a primary card package outlet 144. Otherwise, the card package 115 is passed to a FIFO card package stacker 146 to form a stack of card packages 115'.

Figure 4:
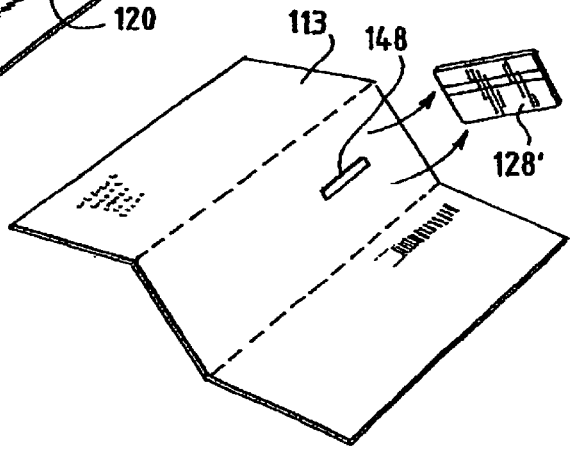
FIG. 4 is a perspective of the card package of FIG. 2 but with the card detached and showing the adhesive label remaining attached to carrier.

Referring to FIGS. 3 and 4, the card 128 is attached to the carrier 113 by means of an adhesive label 148. One side of the adhesive label 148 is attached to the card by a heat activated adhesive, such as releasable adhesive made by MAPLE ROLL, a division of ITW. The other side of the label is attached to the carrier by means of a permanent adhesive. The labels are adhered to a roll of backing paper tape by the permanent adhesive. Preferably, the adhesive labels 148 are those made by MAPLE ROLL note above, or the like.

As illustrated in FIG. 4, when the card 128 is lifted off the carrier 113, the adhesive label 148 remains attached to the carrier 113 and does not adhere to back 128' of the card 128. This is because the attraction of the permanent adhesive to the carrier 113 is stronger than the bond between the heat activated adhesive and the back of the card and, because in keeping with one aspect of the invention only a middle section of the label is heat activated to provide a "dead zone" of nonactivated adhesive at opposite ends of the label 148. Advantageously, once the heat activated label 148 is removed from the back 128' of the card 128, the heat activated adhesive losses its adhesive qualities unless it is again heated to the necessary minimum activation temperature of approximately 160-degrees Farenheit.

Figure 5:
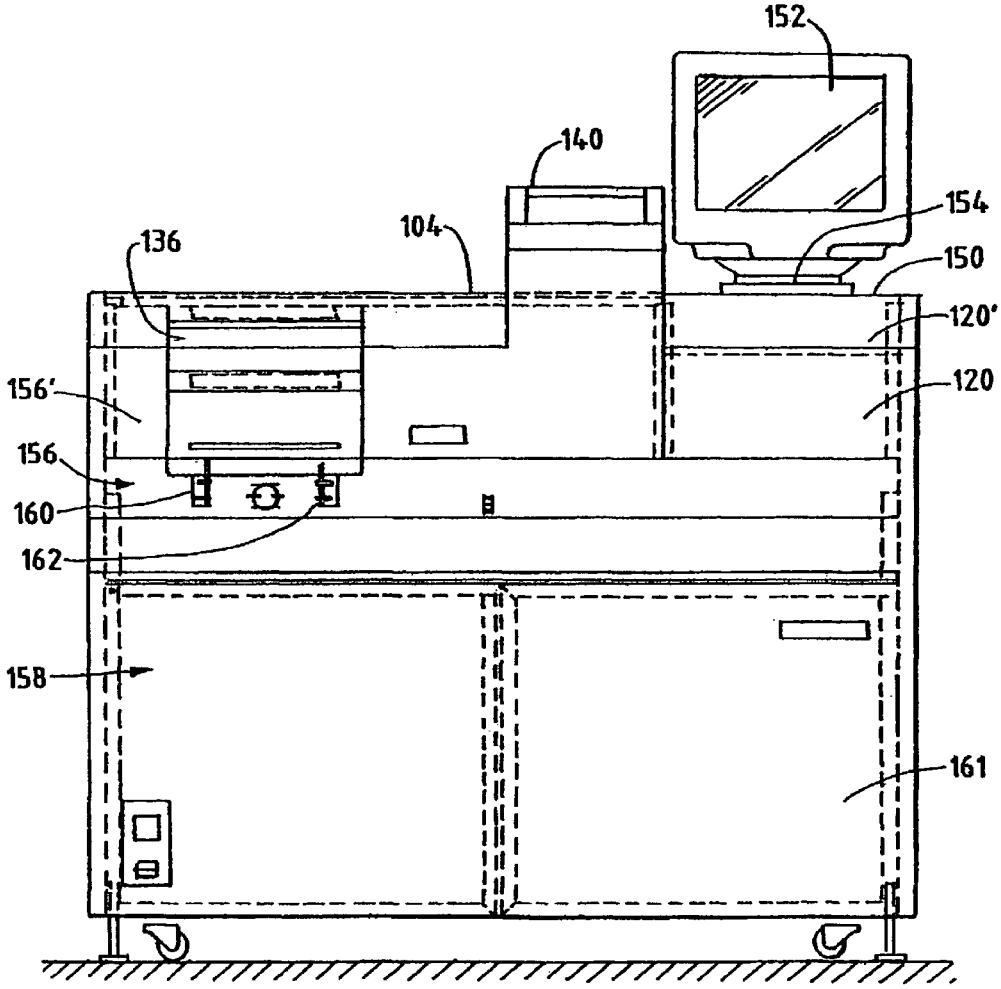
FIG. 5 is a front elevational view of the card package production system of FIG. 1.

Turning now to FIG. 5, the housing has a flat top on which a computer display monitor 152 and a computer keyboard 154 of the computer (not shown) are supported. The computer is protectively contained within the housing section 161. The computer housing section 161 has a hinged door to enable access to the computer. Preferably, the computer that is used to control the card package production system 100 including the attachment module 104 is a model PRESARIO computer made by COMPAQ having a minimum processor speed of 333 MHZ and a minimum hard drive memory capacity of 4 GB, or the like. The computer controls all of the automatic operations of the attachment module 104 and the printer module 102, in accordance with the flow charts of FIGS. 50–60B and 61.

The card attachment module 104 also has a hinged housing section 156 with an upper housing portion 156' that may be elevated for access to the carrier and card transport paths. Both housing sections 104 and 156 are supported on a lower housing section 158 that has a storage space 161. In keeping with one aspect of the invention, the card distribution module 136 which extends in cantilever fashion from the housing frame (not shown) in front of the upper portion 156' of the tracks housing 156, but does not interfere with the opening of the upper housing portion 156'. It is mounted to the frame by means of two elongate bars 160 and 162 that are received within mating bar receptors described below to facilitate easy removal and attachment to facilitate shipping of the distribution module. During shipping of the distribution module 136, the distribution module 136 is detached from the main frame of the attachment module 104 and is inserted into the storage space 161. Upon safe arrival at the customer's site it is easily securely reattached to the housing and in proper alignment due to the two mounting bars 160 and 162 and mounting bar receptors.

Referring to FIG. 7 again, the inter-module guide 122 is aligned with a carrier transport path 164 that extends straight from the carrier inlet 126 toward the card package distribution module 136. However before the carrier reaches the card package distribution module 136, it intersects at a right angle with the card transport path 166 that extends from the card tray 140 to an intersection 168 with the carrier transport path 164. At the intersection 168 card attachment station attaches the card or cards 128 to the carriers. The carriers with attached cards are then folded at a folding station to form card packages 115. The card packages 115 then move along a card package transport path 170 to the card package distribution module and distributed according to the circumstances note above. The card transport path is elevated relative to the carrier transport path and the cards are dropped onto the carriers for attachment. If rejected and not attached, they proceed past the card attachment station along a card reject transport path 172 to the card reject bin 134.

Referring to FIG. 6, it is seen that the printer module 102 is kept in proper alignment with the attachment module by means of a generally triangular brace member 174 fixedly attached to a printer stand 176 of the printer module 102 and at one end. The opposite end is attached to a back wall 178 of a housing portion 158' beneath the track housing 158. The attachment to the back wall 178 is by way of a universal joint with two orthogonal pivot axis defined by locking serews 180 and horizontal pin 182. This universal connection joint facilitates interconnection of the two modules despite slight misalignments of the modules in any direction.

Still referring to FIG. 6, the carrier transport path is seen to include a carrier inlet station with carrier inlet rollers 184, and intermediate station with carrier intermediate rollers 186 and a card attachment rollers 188 at the card attachment station 190 at the intersection 168 of the card carrier transport path 164 and the card path 164, as seen here and in FIG. 7. Following the card attachment station is the carrier folding station 192, and then the card packages are passed to a card package inlet of the card package distribution module 136.

Figure 8:
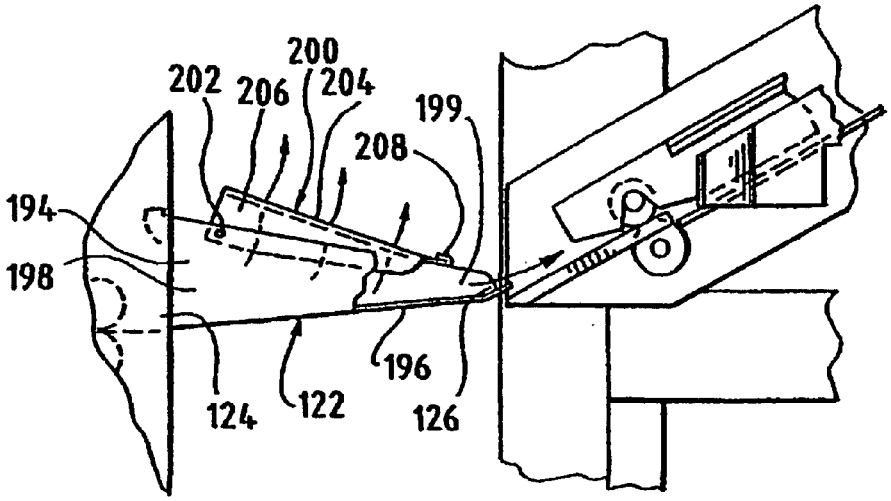
FIG. 8 is side, partially schematic view of the inter-module guide extending between the carrier printer module outlet to the card attachment module carrier inlet shown as also seen in the plan view of FIG. 7.
Figure 9:
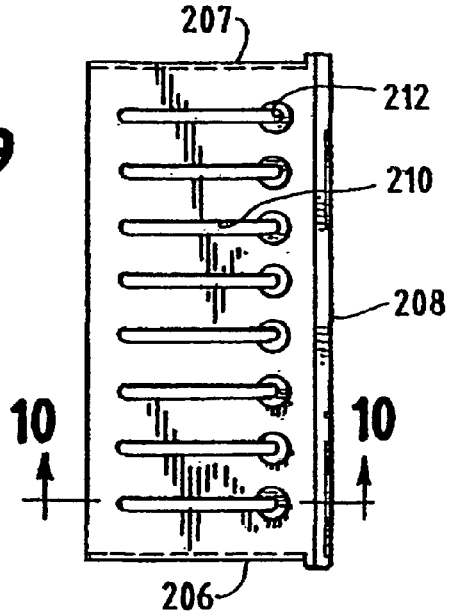
FIG. 9 is a plan view of the inter-module guide showing the release opening in the upper guide body.
Figure 10:
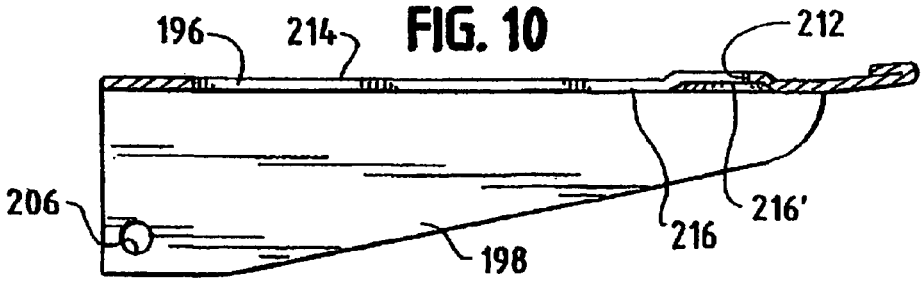
FIG. 10 is a sectional side view taken along section line 10—10 of FIG. 9.

Referring now to FIGS. 8,9 and 10, the inter-module carrier guide, or guide assembly, 122 includes a lower guide body 194 with a generally flat, rectangular, underlying support member 196 extending from the carrier inlet 126 of the attachment module 104 to the outlet end of the printer module 102. Generally right triangularly shaped, parallel guide walls 198 and 199, located at a pair of opposite sides of the underlying support member 196, keep the carriers from moving laterally off of the support member 196 and insures that the carriers straightly enter the attachment carrier inlet. An upper guide body 200 overlying the support member 196 is pivotally mounted to the guide walls 198 and 199 at a pivot axis 202 by means of a suitable hinge pins, and has a cover plate 204 that spans the space between the parallel guide walls 198 and 199. Restraint members 206 and 207 extend downwardly from the cover plate 204 between and respectively adjacent to the guide walls 198 and 199. The bottom edges of the restraint members 206 restrains carriers 113 at their opposite sides against upward movement above the top edge or level of the guide walls 198 and 199 which would result in loss of lateral restraint. In addition, the upper guide body also restrains the carriers 113 against vertical movement to positions out of vertical alignment with the attachment module carrier inlet 126. A curled forward edge 208 of the cover plate 204 is supported atop the walls 198 and 199.

At least one release opening 210 to allow moisture contained within the paper carriers to escape to atmosphere prior to entry into the attachment module. This minimum ventilation has been empirically determined necessary to prevent condensation water from forming within the attachment module adjacent the inlet station.

The condensation is believed to occur when some of the moisture in carrier paper heated from the heat sources and inside the printer, including the light sources used to print onto the carriers, first evaporates. Then as the carrier is passed though cooler air and past the relatively cooler surfaces adjacent the carrier inlet opening of the attachment module 104 the evaporated moisture condenses out onto the cooler surfaces. While the moisture from only one carrier is not significant, when approximately two thousand carriers per hour are passed into the carrier inlet the inlet area becomes wet in the absence of the release opening.

Preferably, there are a plurality of substantially identical, elongate release openings 210 extending in a direction generally parallel to the sidewalls 198 and 199. The eight release openings 210 are generally evenly distributed across the width of the support member 196 and extend a substantial the entire length of the cover plate 204.

Thus, it is seen that in an attachment module of a card package production system being fed carriers from a carrier printer module, a method of reducing the formation of condensation in the attachment module from moisture evaporating from the carriers is provided. This method comprises the steps of (1)providing underlying support for the carriers from an outlet of the printer to an inlet of the card attachment module by means of a lower guide body with a generally flat, rectangular support member extending between the printer, (2) restraining the carriers to remain on the support member with a pair of parallel guide walls carried by the support member, (3) restraining the carriers to remain between the guide walls with an upper guide body having at least one release opening, and (4) passing moisture evaporated from the carrier paper through the at least one release opening to atmosphere before the carrier enters the attachment module.

Because the release openings are elongate in a direction generally parallel to the sidewalls, the moisture is passed through the elongate opening substantially along the entire guide body.

Snagging of the carriers by the forward edge of the release openings is reduced by the step of providing the upwardly recessed portion 216' of the bottom surface 216.

Because there are a plurality of substantially identical release opening distributed generally equally across the support member the step of passing moisture is performed generally evenly across substantially an entire width dimension of the carrier while the carrier is crossing from the printer module to the attachment module.

Referring to FIG. 10, each of the elongate release openings 210 has a forward edge 212 closest to the carrier inlet 126 that is arcuate. The support member 196 has a top surface 214 and a bottom surface 216. Apportion 216' of the bottom surface 216 adjacent the forward edge 212 of the elongate opening 210 is recessed upwardly toward the top surface 214. This recessed portion 216' reduces snagging of the carriers 113 by the forward edge 212 of the release opening 210. The arcuate shape of the recessed portion 216' is generally concentric with and generally conforms in shape arcuate shape of the forward edge 212. Adjustable legs 214, FIG. 6, provide the means for mounting the underlying support member 196 in alignment with the carrier inlet 126 of the attachment module 104.

Figure 11:
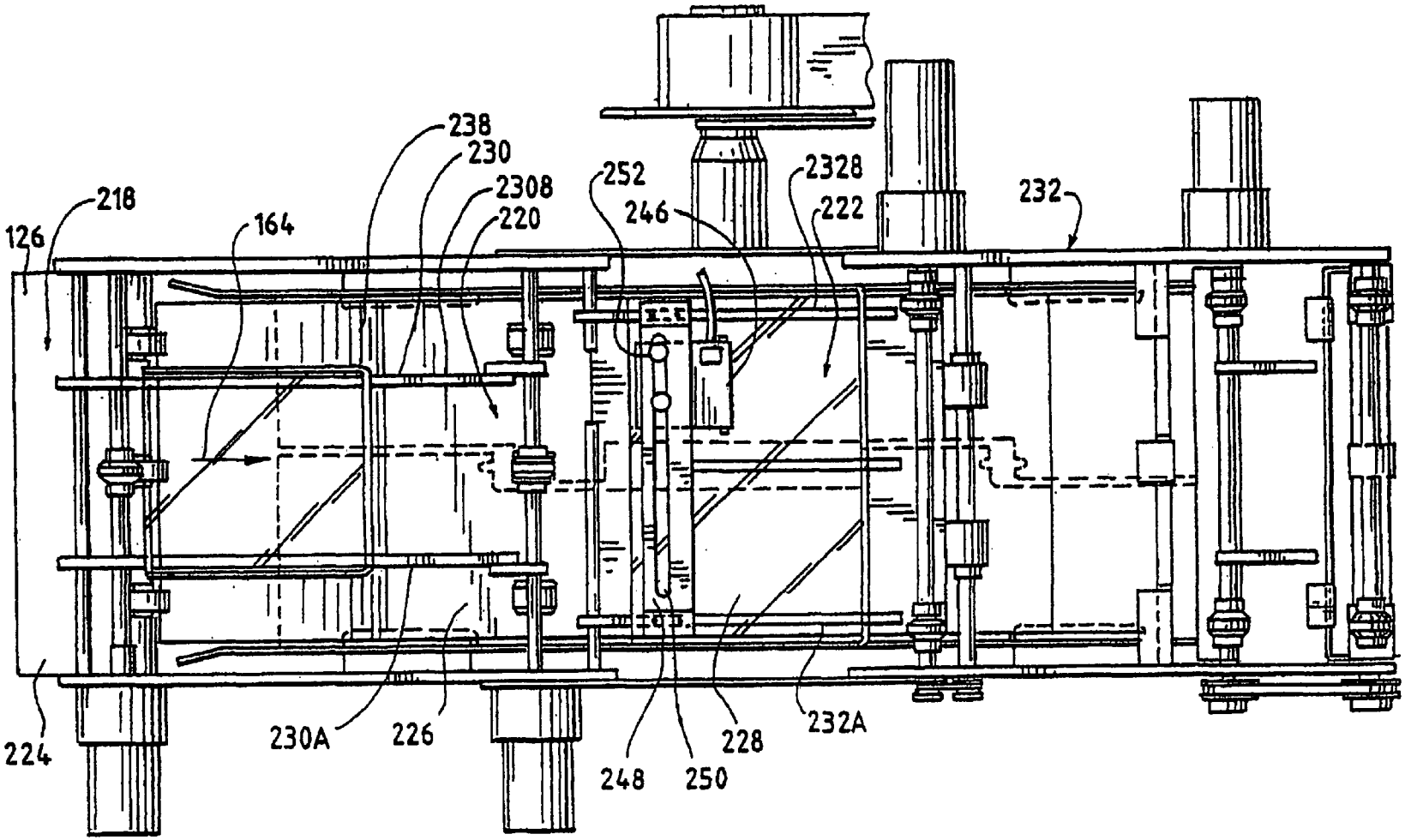
FIG. 11 is a plan view of the carrier transport showing the carrier inlet station, the intermediate standby station, the card attachment station and the folding station.
Figure 12:
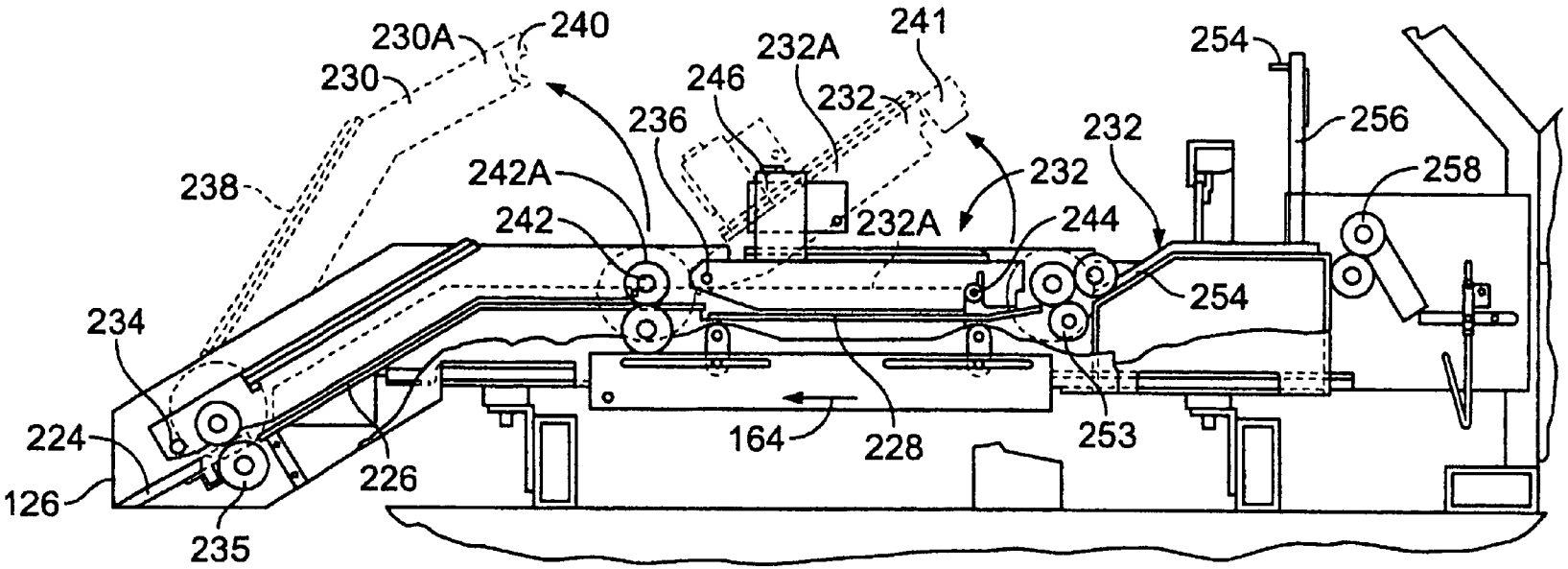
FIG. 12 is a side view of the carrier transport with carrier restraint assemblies shown in broken line in their inoperative elevated positions to provide access to enable clearing of jams and general maintenance.
Figure 13:
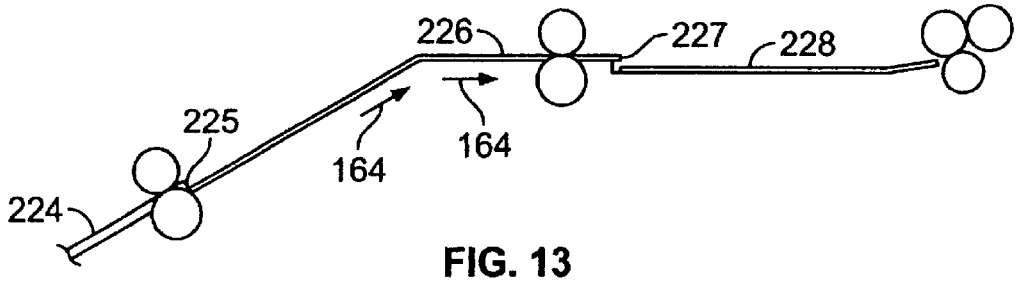
FIG. 13 is a schematic illustration of a side view of only the multilevel carrier transport shown in FIG. 12.
Figure 14:
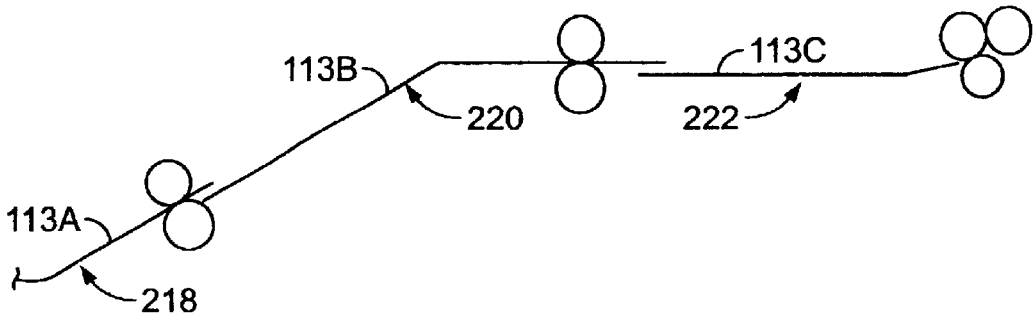
FIG. 14 is a schematic illustration of the movement and the overlapping position of the carriers on the multilevel support of FIGS. 12 and 13 in the event of the card package production system being stopped during operation.

Referring to FIGS. 11–14, another advantageous feature of the invention is provision of a carrier transport path with an anti-jamming carrier transport mechanism. The carrier transport path 164 has a carrier inlet station 218, followed by an intermediate, standby station 220 which, in turn, is followed by a card attachment station 222. These stations have underlying carrier support members 224, 226 and 228 as best seen in FIG. 12. The forward, or upstream, edges of carrier support members 224 and 226 are elevated relative to the downstream edges of carrier support members 226 and 228, respectively, at junctures 225 and 227, as best seen in FIG. 13. Accordingly, should a carrier still be in a position resting on support members 224 and 226, another carrier may be still passed into the standby station 220 and the card insertion station 222 without jamming into the end of the preceding carrier and thereby causing a jam. Instead, referring to FIG. 14, because of the relative differences in elevation at 225 and 227, a carrier 113A may be passed from the inlet station 126 into overlying relationship with respect to the downstream end of the carrier 113B which is already at the intermediate standby station 220, as illustrated in FIG. 14. Likewise, if the carrier 113B enters into the card attachment station while another carrier 113C is still at the card attachment station, the carrier 113B will pass over the top of the carrier 113C instead of jamming into the lagging end of the carrier 113C. This anti-jamming feature can be used to increase the rate of carrier throughput rate down the carrier path. However, under normal speed operation only the carrier 113A will overlap the carrier 113B only when an incorrectly prepared card package 115 is detected and the printer passes one more carrier 113 to the carrier inlet 126 after the carrier transport mechanism has been stopped and the printer given a stop command.

Referring to FIGS. 11 and 12, the intermediate standby station 220 and the card attachment station 222 have movably mounted carrier restraint assemblies 230 and 232, respectively. Carrier restrain assembly 230 is mounted for pivotal movement about a pivot axis 234, and carrier restraint assembly 232 is pivotally mounted for rotation about an axis 236 by a suitable hinge assembly. Each of the carrier restraint assemblies 230 and 232 has a pair of parallel, elongate, vertical restraint members, such as vertical restraint members 230A and 230B of restraint member 230 which are fastened together by a protective cover plate 238. The restraint members are thus mounted for pivotal movement between an operative, down position in which they disposed generally parallel to the carrier transport path and slightly above it to prevent the carriers from rising off the path, and an inoperative position. In the inoperative position, as shown in broken line in FIG. 12, the restraint assemblies are pivoted up and away from the carrier transport path 164 to enable manual access to the carrier path 164 for maintenance and for manually removing carrier forms 113 from the carrier transport path. The protective carrier plate, such as cover plate. 238, is made of substantially transparent plastic to enable viewing of the carriers 113 moving along the carrier transport path 164.

When in the operative position, the parallel arms, such as arms 230A and 230B are held in operative position by a generally C-shaped resilient snap fasteners 240 at the ends of the arms opposite the pivotal connection. The resilient snap fasteners 240 of the restraint assembly 230 releasably lock the ends of the arms 230A and 230B to the axle of an upper roller 242A of an intermediate roller assembly 242, and resilient snap fasteners 241 at the ends of arms 232A and 232B are resiliently locked to mating posts 244 fixedly mounted at opposite sides of the carrier transport path 164. The snap fasteners enable the carrier restraint assemblies to be moved into and out of the operative positions without the need for any tools.

Another feature of the present invention is the provision of a bar code reader 246 that is mounted to the carrier restraint assembly 232 and moves with the restraint assembly 232 when pivoted to the inoperative position. Unlike most bar code readers that employ a laser light source which could scan over and damage a person's eye when being moved to different positions with the restraint member 232. However, in the present invention a non-laser light source is employed in the bar code reader 246 to read bar code 120 from carriers 113 passing by the restraint member 132. When the restraint assembly 132 is in an operative, down position the bar code 120 can be read and the bar code reader 246 is operative. When the restraint assembly 132 is moved to the inoperative position then the bar code 120 cannot be read and the bar code reader 246 is in an inoperative position. The use of a non-laser light source eliminates any risk of laser beams striking a person's eye during movement of the bar code reader 246 between the operative and inoperative positions and thus enable such movable mounting. Preferably, the bar code reader 246 is a model BL185 bar code reader made by KEYENCE.

As best seen in FIG. 11, the bar code reader 246 is adjustably mounted to the restraint assembly 232 by means of a mounting member 248 with an elongate slot 250 and fasteners 252 that are attached to the bar code reader 246 and ride within the slot 250. The elongate slot 250 substantially spans the carrier path to enable reading of bar code at different locations on the carrier 113.

As seen in FIG. 11, the intermediate station also has a pair of parallel, lateral guide walls 231 and 233 on opposite sides of the carrier path to keep them moving in a direction parallel to the carrier transport path 164 and normal to the elongate directions of the rollers. The entry ends have canted, or funnel, portions 239 and 241 that are farther apart than the remaining interior portion of the guide walls 231 and 233 and wider than the carriers 113 at their open ends and then taper inwardly to insure receipt of the carriers 113 within the opening between the funnel portions. Advantageously, the separation between the lateral guide walls 231 and 233 is easily adjustable to accommodate carrier of different size by means of manual movement of a simple lever 241, FIG. 15, between two different positions.

Figures 15, 16, 17:
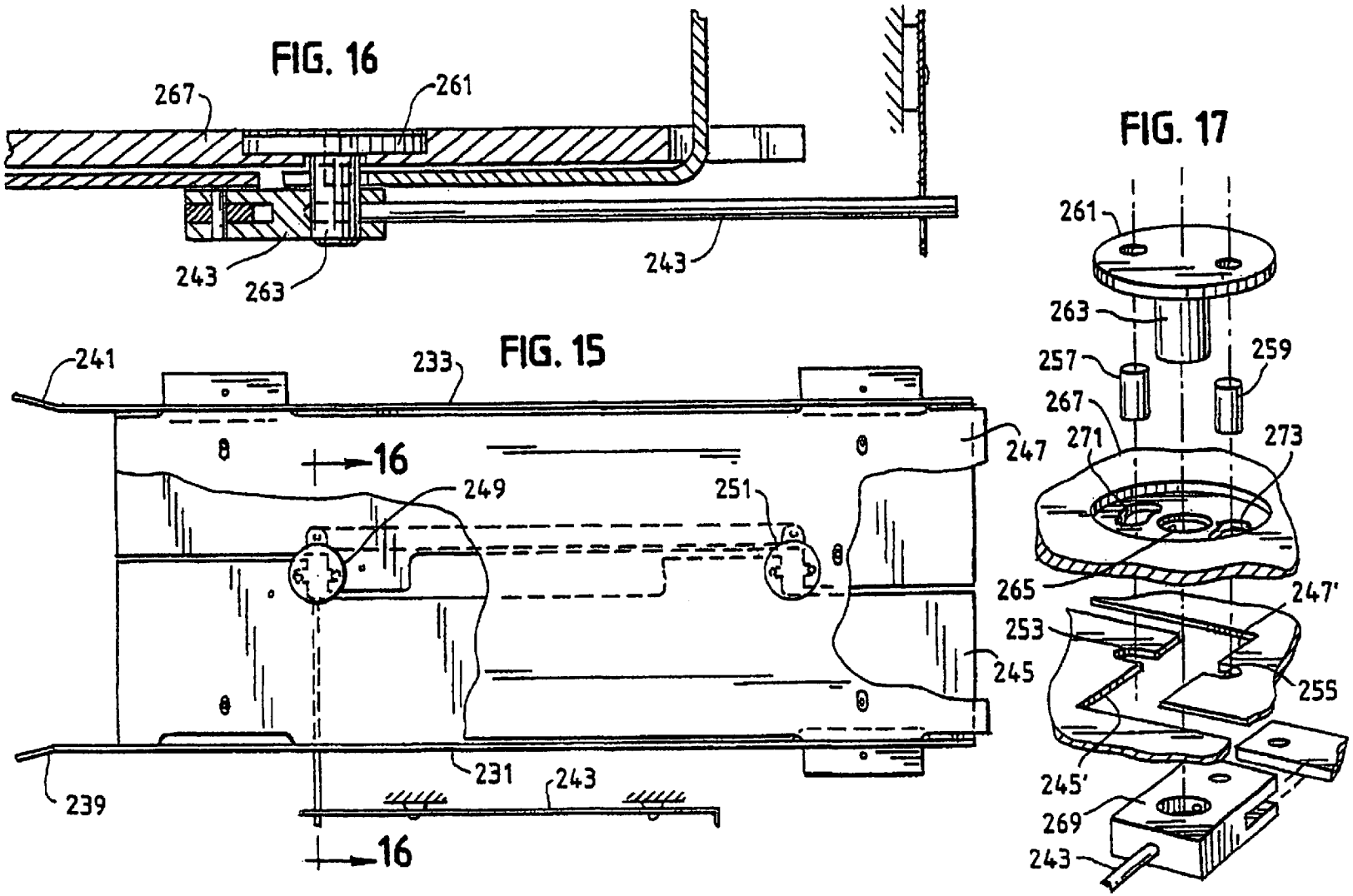
FIG. 15 is a plan view of the adjustable carrier restraint assembly for keeping the carriers on the carrier transport path.
FIG. 16 is a sectional side view taken along section line 16—16 of FIG. 15.
FIG. 17 is an exploded perspective view of the carrier guide adjustment assembly shown in FIGS. 15 and 16.

Referring to FIGS. 15, 16 and 17, the manually actuatable lever 243 is mounted for pivotal movement between two positions respectively associated with two different carrier widths: standard U.S. letter width and European A4 width. When the lever is in the forward position as shown in FIG. 15, the guide walls are located relatively far apart to accommodate standard U.S. letter size carriers and when the lever 243 is moved to an a rearward position, as shown in FIG. 16, then the lateral guide walls 231 and 233 are moved through a linkage with the lever 243 to move the guide walls nearer to each other to accommodate A4 size carriers. The linkage advantageously maintains the walls in generally parallel relationship while they are being moved. The walls are respectively carried at the opposite sides of two separate plates 245 and 247 that are mounted for movement toward and away from each other in response to actuation of the lever 243. The plates 245 and 247 are separated across their width and also along their length at edges 245' and 247' at two junctures 249 and 251. As best seen in FIG. 17, the edges have arcuate slots 253 and 255. A pair of cylindrical pins 257 and 259 are carried by a pin holder 261 with an axle 263. The passes through a central mounting hole 265 of fixedly mounted support member 267 and into locked engagement within a mounting hole in a lever connector 269. The drive pins 257 and 259 that also mounted within mounting hole in the top of the pin holder 261 also extend through arcuate pin guide slots 271 and 273 and into the slots 253 and 255, respectively, on opposite sides of the axle mounting hole 265. When the lever connector 269 is rotated by movement of the lever 243, the axle is rotated which causes the pins 257 and 259 to rotate. When the pins are rotated in one direction the plates edges 245' and 247' of the plates are slid closer together and when the pins are rotated to another position that is normal to the one position then the plates are moved to their closest position.

In addition to adjusting for the widths of different types of carrier, the card package production system also has means for adjusting for the different lengths of the carriers 113. Referring again to FIG. 21, the fixed folding wall 254 has a stop 254' at the top and a stop mounting bracket with adjustment screws and slots for mounting the stop 254' at different levels, as shown in broken line. Likewise, Referring to FIG. 24, the end 259' of the pivotal folding wall 259 is likewise adjustable in the same manner to different positions as shown in broken line.

Referring to FIG. 12, another advantageous feature of the invention is that the card attachment station 190 has a set of rollers 253 that are controlled to reverse direction after a card 128 with a heat activated label 148 has been dropped onto the carrier 113. The rollers 252 first rotate in one direction to move the selected portion of the carrier 113 to the card drop location. The card 128 with an adhesive label attached 148 is then dropped onto the portion of the carrier that is resting on the upwardly slanted carrier support 254 on the upstream side of the set of rollers 252. After the card is dropped onto the carrier 113, the card 128 slides down the slanted carrier at the slanted carrier support 254 and against the upstream one of the set of rollers 252. Then the rollers 252 are controlled to reverse direction to partially pass the carrier 113 with the card 128 on the carrier in a downstream direction back past and between the set of rollers 252. The set of rollers 252 then press the permanent, pressure sensitive adhesive on the label attached to the card and the card 128 against the carrier 113 to adhere the card 128 to the carrier 113. After the card 128 has been adhered to the carrier 113 during this reverse rotation of the rollers 252, the rollers 252 are controlled to again reverse direction move the carrier with the adhered card in the upstream direction toward the folding station 192.

Figures 18, 19, 20, 21, 22:
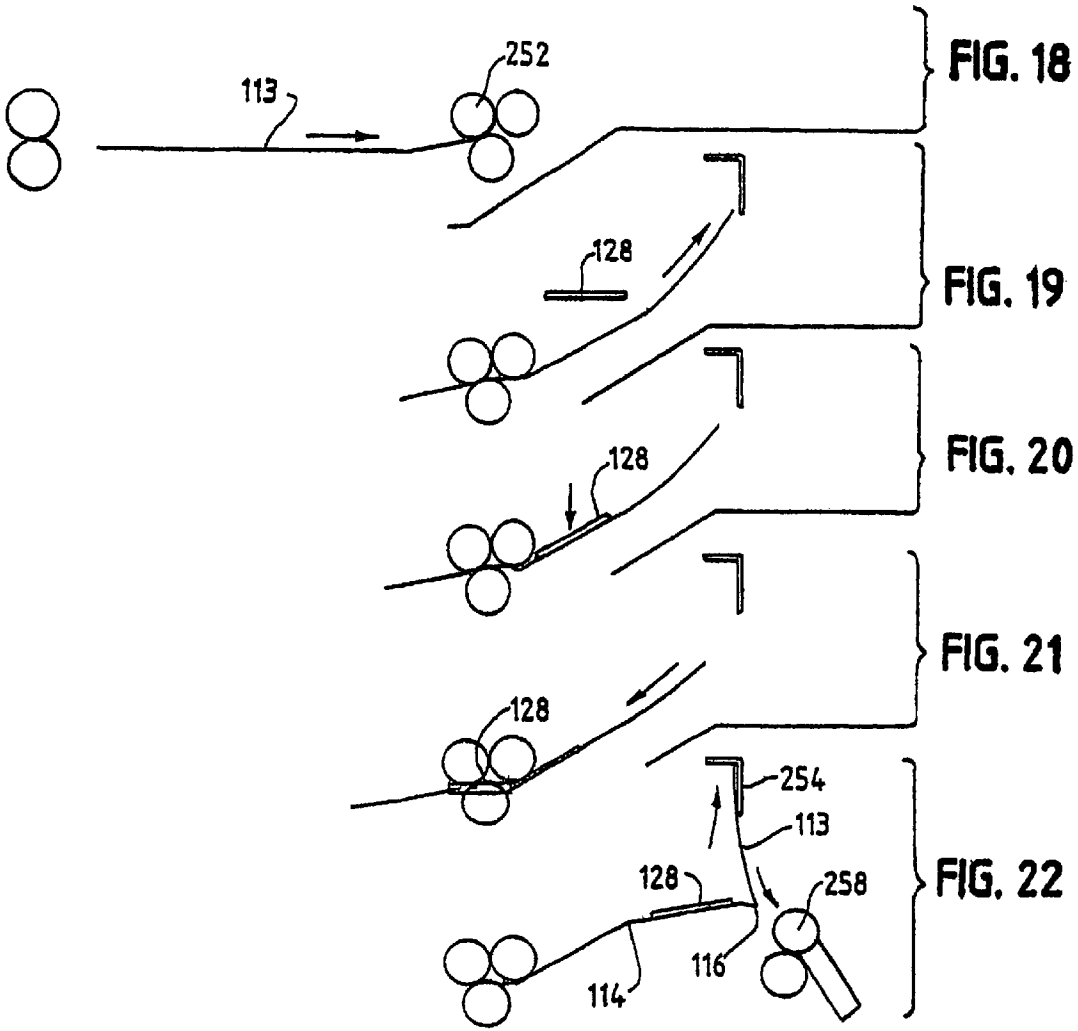
FIG. 18 is a schematic illustration of the movement of the carrier being passed to the card loading station.
FIG. 19 is a schematic illustration of the carrier at the card attachment station immediately before the card drops onto the carrier to which it is to be attached.
FIG. 20 is a schematic illustration of the carrier at the card attachment station after the card has dropped onto the carrier and slid downwardly to the nib of the card attachment station carrier feed rollers.
FIG. 21 shows the carrier feed rollers reversing direction to again pass, in reverse direction, the carrier and the card resting on the card partially back through the set of rollers to press the card with the attached adhesive label to the carrier sufficiently to ensure adhesive attachment of the card to the carrier.
FIG. 22 shows the carrier with adhesively attached card being passed to the second stage of the carrier folder.

This sequence of events is schematically illustrated in the sequence of drawing FIGS. 18–22. In FIG. 18, the carrier 113 is seen approaching the set of rollers 252. In FIG. 19, the carrier 113 pauses in the correct position for receipt of the card 128 on the middle panel, for example. In fact, the carrier may be positioned for receipt of cards at any of the three panels. In such case the cards are attached to the different panels at different time with the panels moving successively into position to receive the cards and then backing up each time to press the cards against the carriers. The card attachment station has a plurality of different lateral positions from which the card can be dropped, and the controller controls the card attachment station to drop the card at a preselected one of the plurality of different lateral positions. The card attachment station includes means for dropping a plurality of cards onto a plurality of different preselected card attachment positions on a single carrier, and if multiple cards are to be attached to the carrier 113 then the carrier is held in the correct position to receive all of the cards before the carrier is backed through the set of rollers 252 so that all cards are pressed against the carrier simultaneously.

In FIG. 20, the card 128 has dropped onto the carrier 113 and slid down to a position with an edge held between the nib of the upstream roller and the carrier 113. In FIG. 21, the set of rollers 252 is reversed and the carrier is partially backed through the set of rollers 252 to press the card 128 against the carrier 113. In FIG. 22, the set of rollers have again reversed direction to pass the carrier with adhesively attached card to the folding station 192.

Advantageously, the bottom one of the set of rollers 252 is mounted for resilient self-adjustment to accommodate different thickness of carriers without attached cards and carriers with different number of attached cards. The axle to which the lower roller is mounted is mounted in a slot and is spring biased in an upward direction in a manner that will be illustrated with reference to other resiliently movably mounted rollers of the card package distribution module 136.

Figures 23, 24, 25, 26:
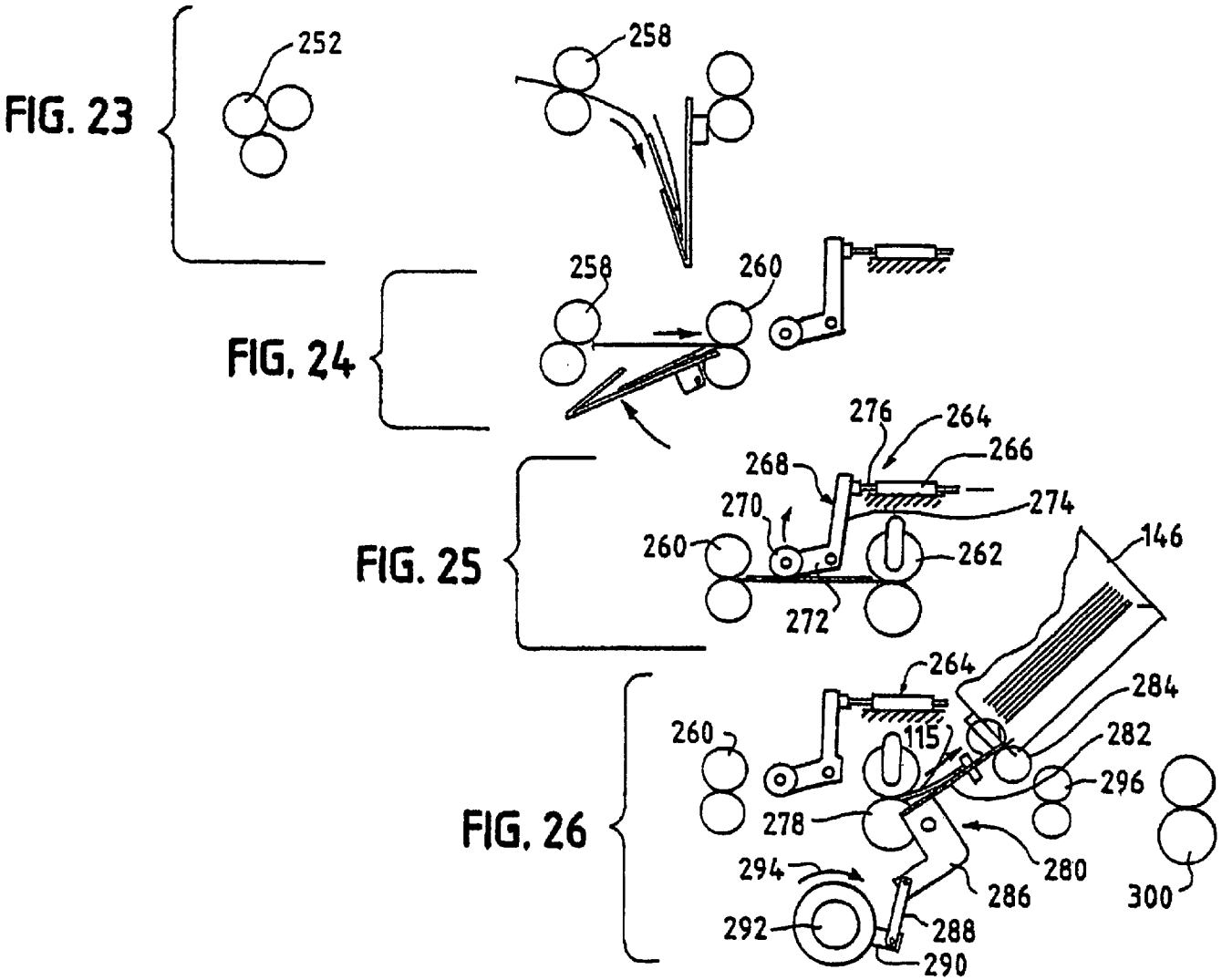
FIG. 23 shows the carrier with adhesively attached card being passed to the second stage of the carrier folding station.
FIG. 24 shows the carrier at the third stage location in which the newly folded carrier is being moved to the card count detection stage.
FIG. 25 shows the card count stage in which the thickness of the loaded and folded carriers are measured at a plurality of locations to determine the number and correct location of the card or cards attached to the carrier.
FIG. 26 shows the folded carrier with attached card or cards being moved to the FIFO stacker module due to the uplifting actuation of the stacker gate.

The card package distribution module 136, as previously note, has a card package reject bin 142 to which card packages are passed that have too many cards, too few cards or cards in an incorrect location. Referring to FIGS. 25, this determination is made by measuring the thickness of the card packages after they have been produced at the folding station 192.

The folding begins when the forward edge of the card is pressed against a stop member 254 at the top of a folding wall 256, schematically shown in FIG. 22, and also seen in FIG. 12. After hitting the stop member, continuing forward movement caused by forward rotation of the set of rollers 252 causes the carrier 113 to buckle at fold line 116. The fold line 116 is then pushed into engagement with another set of rollers 258, seen in FIGS. 22 and 23. Referring to FIG. 23 the leading edge of the partially folded carrier is then pushed into a V-shaped, pivotally mounted folding wall 259, and the carrier 113 is folded along fold line 114. referring to FIG. 24, the panels on opposite sides of the fold line 114 are then pushed into the nib of a pair of rollers 260. This causes the entire carrier to pivot upwardly whiles still contained within the V-shaped folding wall 262 and to then pass entirely through the rollers 260 to card package input rollers of the 262, as schematically illustrated in FIG. 25.

Referring to FIG. 25, between the outlet rollers 260 of the folding station and the intake rollers 262 of the distribution module 136, a defective carrier detector 264 located along the primary carrier transport path 164 detects defective card packages 115. The determination of whether a card package is defective is made by measuring the thickness of the card package at a plurality of locations across the carrier 113. This measurement is made with a plurality of substantially identical linear potentiometers 266, each of which is linked through a resiliently biased, bent, elbow-shaped lever 268. The bent lever 268 is mounted for pivotal movement about a pivot axis 269 and is resiliently biased by a spring (not shown) of the linear potentiometer to pivot against and ride on top of the carrier packages 115 as they pass. A roller 270 is attached at the end of a relatively short arm 272 extending from the pivot axis 269 that resiliently presses against the carrier packages 115. Another relatively longer arm 274, approximately twice as long as the relatively short arm 272, is attached to a plunger 276 of the linear potentiometer 266. When the roller moves up a given distance the end of the long arm 274 and the plunger 276 moves approximately twice the distance for an enhanced resolution factor of approximately 2:1.

The movement of the plunger creates different levels of voltage output signals of the potentiometer 266 that are translated by the controller and compared to the thickness that the card package 115 under consideration should have if it has the correct number of cards 128 that have be preselected for the particular carrier 113. The linear potentiometer 264 is preferably one made by BOURNS.

Figures 27, 28, 29:
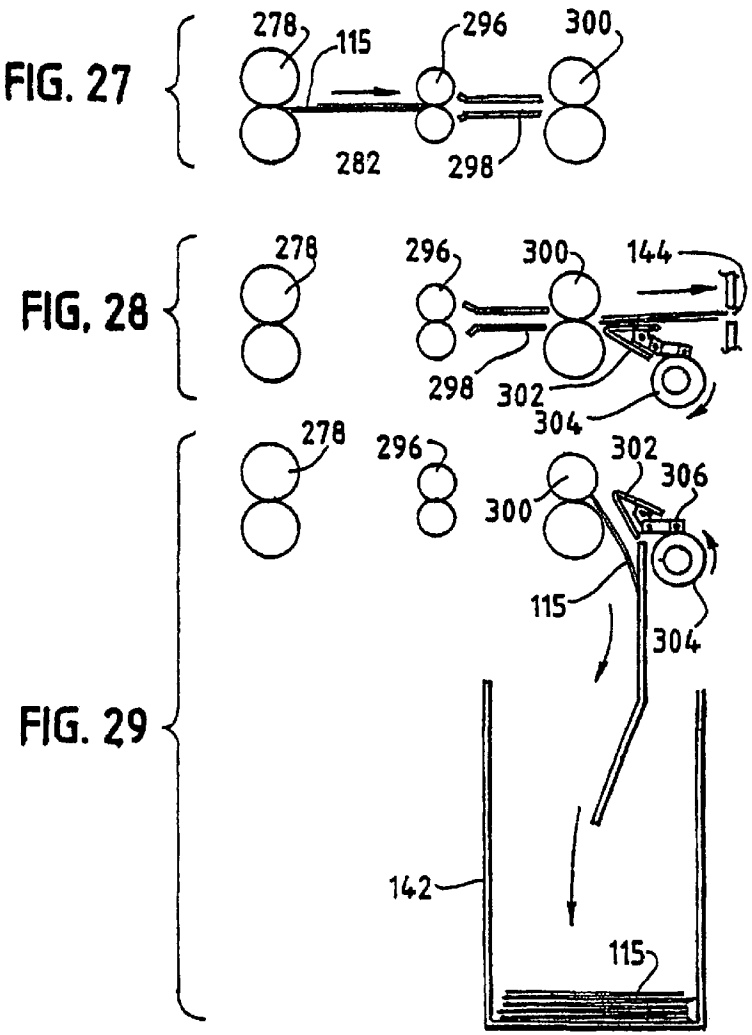
FIG. 27 shows the card package passing the card stacker gate to move to a reject gate.
FIG. 28 shows the card package being moved past the reject gate to a card package outlet that is generally connected to an envelope stuffer (not shown)
FIG. 29 shows the card package being directed away from the primary card package outlet by a reject gate and, instead, being re-directed to a card package reject bin.

If the card package 115 has the correct number and locations of cards 128 that have been pre-designated for the carrier 113 in question, then depending upon other preselections for the card package 115, it is passed to either the primary card package outlet 144, FIG. 1, as shown in FIG. 28, or is diverted to a card stacker location as shown in FIG. 26. However, if correctness is not the case, then the card package 115 is passed to the card package reject bin 142, as shown in FIG. 29. A simplified flow chart for control of the reject gate is shown in FIG. 61 to which reference should be made.

Referring to FIG. 26, if the card package has been selected for stacking and is not to be rejected, then after thickness measurement by the linear potentiometer 266, the card package is passed through another set of rollers 278 to a stacker gate assembly 280 which is moved to a stacker position as shown. The stacker gate assembly 280 has a gate 282 that engages the bottom of the carrier package 115 to direct the card package upwardly into a pair of stacker rollers 284 when in the uplifting stacking position shown. The gate is pivotally mounted to a linkage 286 that, in turn, is connected through another pivotal linkage 288 to a rotatable arm 290 of a rotary solenoid 292. When this stacker gate solenoid 292 is energized by the controller, the arm 290 rotates in the direction of arrow 294 to the stacking position shown in FIG. 26.

Figure 30:
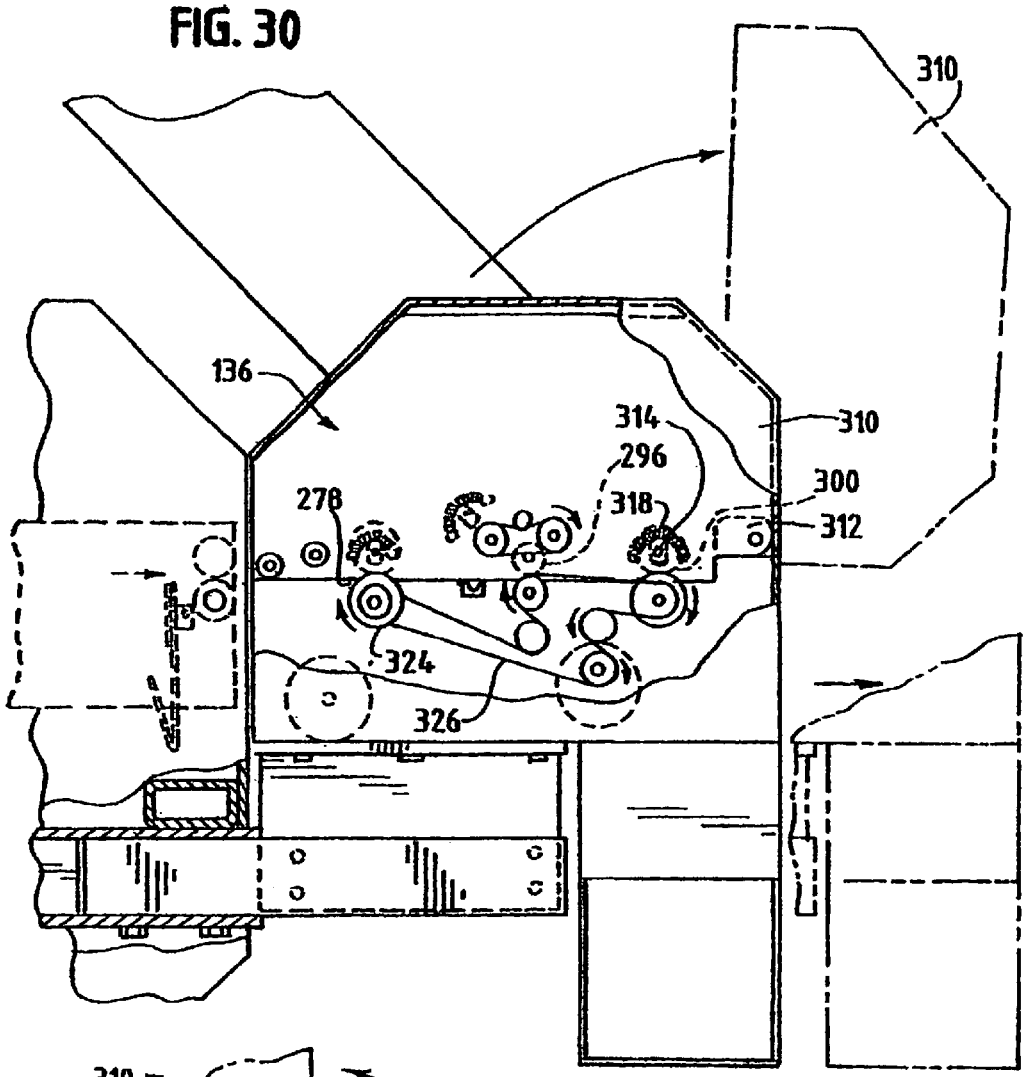
FIG. 30 is a side elevational view of one side of the "clam shell" card package distribution module of the card package production system of FIG. 1 with parts broken away to show the rollers and integrated drive system, and also illustrating in broken line the pivotal open position in which card packages may be removed or jams may be cleared and maintenance be easily performed.
Figure 31:
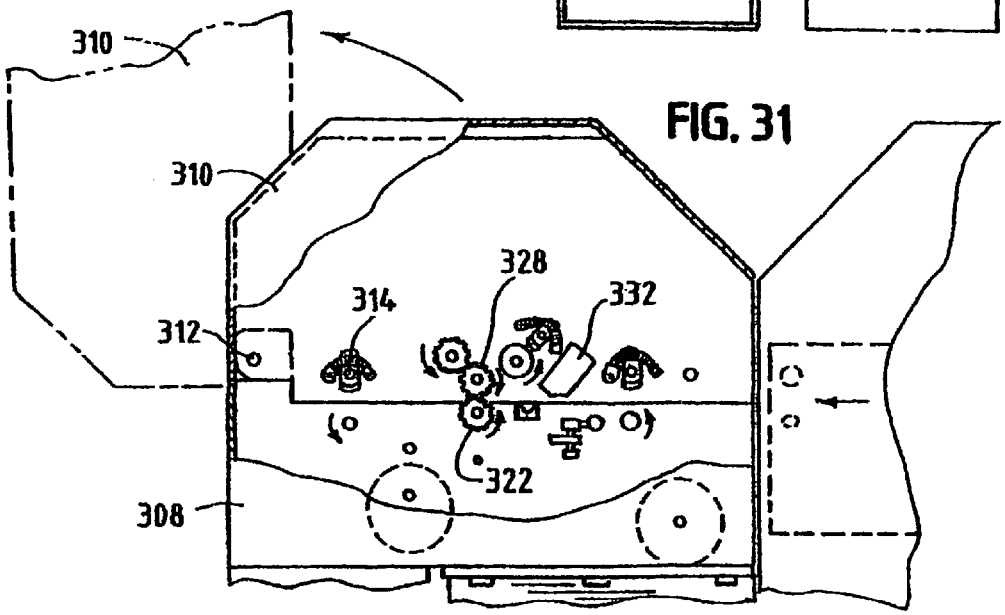
FIG. 31 is a side elevational view of another side of the "clam shell" card package distribution module of FIG. 30 showing the intermeshing drive and driven gears in the hinged lower and upper module frames.

Referring to FIG. 27, if the stacker solenoid 292 is not energized, then the stacker gate 282 is moved to a generally horizontal position to direct the card package to another set of rollers 296 and through a guide 298 to yet another pair of rollers 300. After entering the pair of rollers 300, the card package is either allowed to continue on a primary card package transport path past a reject gate 302 to the primary card package outlet 144 for passage to an envelope stuffing machine (not shown), as illustrated in FIG. 28, if not detected to be a reject, or the reject gate 302 is actuated to redirect the card package to the card package reject bin 142 primary output 144, as shown in FIG. 29, if the card package is to be rejected. Actuation of the solenoid is achieved by means of a rotary solenoid 304 connected directly to the reject gate 302 by an arm 306. both solenoids 292 and 304 are preferably solendoids made by LUCAS LEDEX. The stacker gate solenoid is Model No. 810-282-530 and the reject gate solenoid is Model. No. H-1146-033. Referring to FIGS. 30 and 31 another advantageous feature of the card package distribution module is that has a foldable "claim shell" configuration to enable easy access to the internal workings of the distribution module 136 previously describe with reference to FIGS. 26–29. The distribution module 136 has a base distribution module frame 308 and a top distribution module frame 310. A hinge 312 interconnects the base distribution module frame 308 and the top distribution module frame 310 for relative pivotal movement. The relative pivotal movement is between an open position for access to the interior of foldable distribution module 136 between the base distribution module frame 308 and the top distribution module frame 310, as shown in broken line in FIGS. 30 and 31, and a closed, operative position in which the internal workings are protected between the top frame 310 and the bottom frame 308, as shown in solid line in FIGS. 30 and 31.

Referring to FIG. 30, the base module frame 308 contains the bottom rollers of the roller sets 278, 296 and 300 one transport roller for engagement with and transport of the carrier while the top distribution frame 310 mounts the mating upper rollers of the roller sets 278, 296 and 300. When the top distribution frame 310 is closed on top of the base distribution frame 308, the mating rollers of the roller sets are moved into operative interrelationship with one another, but when the top frame 310 is moved to the open position shown in broken line then they are completely separated and any card packages previously held between the upper and lower rollers may be easily accessed and removed.

Figure 32:
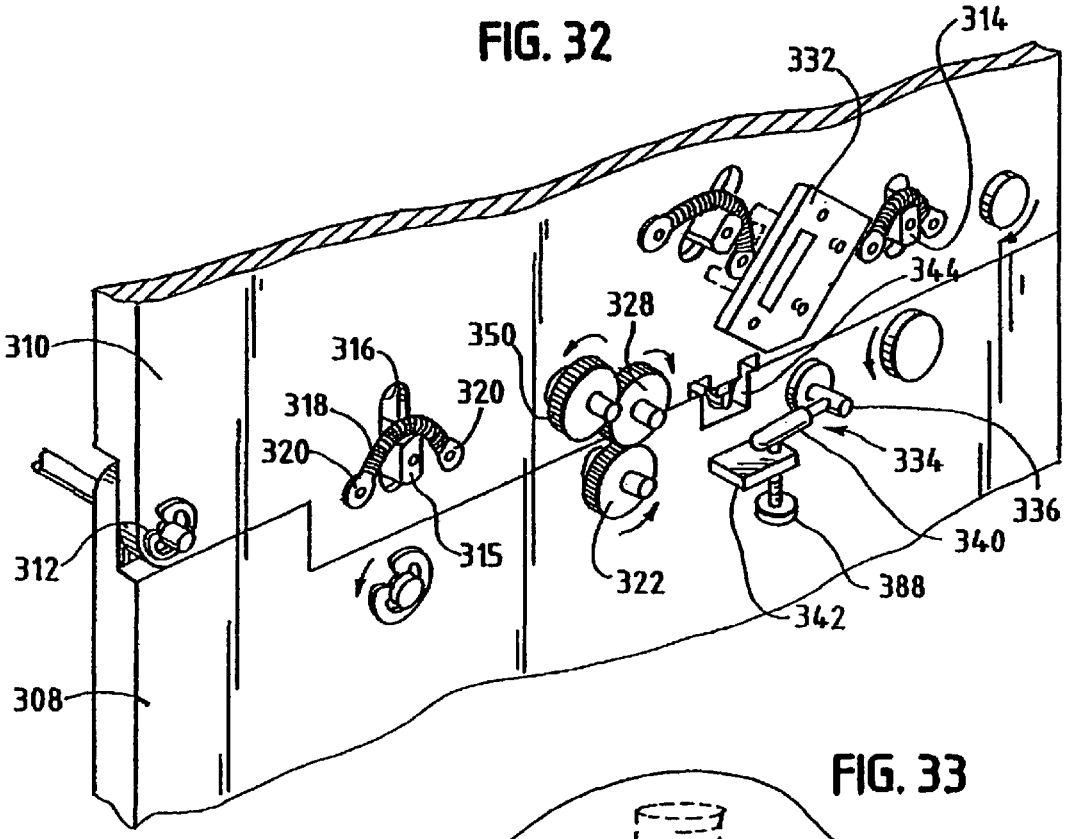
FIG. 32 is an enlarged perspective view of the side of the distribution module of FIG. 31 providing a better view of the intermeshing gears and resilient mounting of the rollers.

As best seen in FIG. 32, this is achieved in part by mounting each of the opposite ends of the axles of the top rollers of the roller sets, such as roller set 300, to a male axle mount 314 that has a rectangular cross section and is mounted for sliding movement toward and away from the bottom roller of the roller set within a slot 316 within in the side of the upper frame 310. The axle mount 314 is spring biased toward the bottom roller by means of a coil spring 318 that is stretched over the top of the axle mount protruding through the slot 316 from the top frame 310 and anchored to posts 320 on opposite sides of the mounting slot 316. This resilient mounting of the upper rollers causes the upper rollers to self adjust into operative relationship with the lower rollers when the two halve of the "clam shell" are brought together and to adjust for card packages of different thickness.

Still referring to FIGS. 31 and 32, the "clam shell" design is also made possible by means of arranging a drive gear 322 mounted the base distribution frame 308 and powered by a motor 324 and a pulley linkage 326, FIG. 30, both of which are mounted within the base distribution frame 308 to mesh with a driven gear 328 mounted within the top distribution frame 308. The driven gear 328 is linked to another gear 330 that, in turn, drives the bottom roller of the stacker roller set 284 to move card packages into the stacker loading position. Thus, the upper frame neither requires its own motor or wiring connection for a motor and the upper and lower rollers automatically self-adjust so no manual adjustments are needed after the distribution module is opened and again closed.

Still referring to FIG. 32, the upper distribution frame also carries a photosensor 332 for sensing the card package 115 when it is opposite the sensor. The photosensor 332 is mounted for movement within a slot to two different positions associated with sensing card packages using standard 8-½"×11" sized carriers 113 or carriers of A4 size which is slightly narrower and slightly longer.

Also, seen in FIG. 32, is an adjustment mechanism 334 for adjusting the bypass level of the stacker gate 282. The stacker gate pivots with a rotating axle 336, and blocking adjustment screw 338 engages a mating radial arm 340 extending from the axle 336 to prevent the axle 336 from further rotation. The blocking screw is threaded into a mounting tab 342 to enable threaded adjustment of the level at which the blocking adjustment screw 338 engages the mating radial arm 340.

Figure 33:
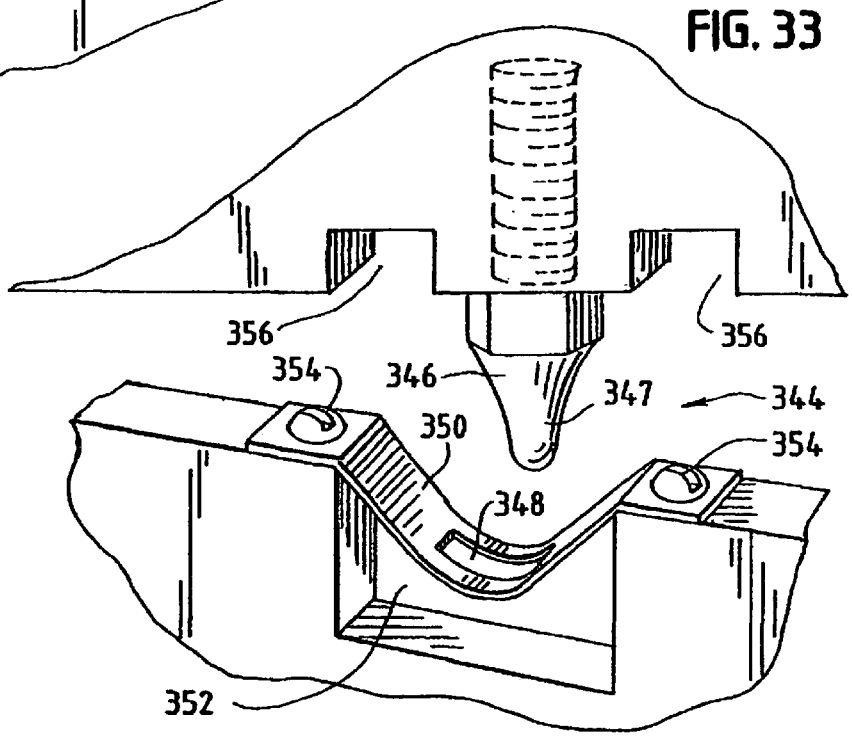
FIG. 33 is an enlarged perspective view of either side of the distribution module of FIGS. 30 and 32 showing the releasable fasteners used to hold the upper frame and the lower frame in closed operative engagement.

The distribution module also has a pair of substantially identical, releasable lock assemblies on opposite sides of the distribution module, such as lock assembly 344, FIG. 32, that releasably hold the upper frame 310 lateral movement relative to the lower frame 308. Referring to FIG. 33, the distribution module lock assembly 344 has a male lock member 346 with a tapered end 347. The male lock member is threaded into a bore in the bottom end of the upper frame side wall to allow for vertical adjustment. The tapered end 347 is aligned with and received within a mating female lock receptor slot 348 in a U-shaped cross member 350 whenever the upper and base frames are closed together in operative relationship. The cross member 350 spans a slot 352 in the upper end of the base frame side wall. Screws 354 secure the ends of the cross member 350 to the top of the side wall, and cutouts 356 provide space for the mounting screws 354.

Referring to FIG. 30, the mounting bars 160 of FIG. 6 that enable easy removal of the card package distribution module 136 plural, have a generally rectangular cross section and are fixedly attached to the underside by means of an L-shaped mounting bracket 358 with one leg bolted to the underside of the base distribution frame 308 by bolts 360. The other leg extends vertically downwardly and is attached to one end of the mounting bar 160 by means of four other bolts 362. The protruding end of the bar 160 has a beveled end 160' to facilitate insertion into a mating mounting bar receptor 364 fixedly attached to the main frame of the attachment module 104. The receptor 364 has a rectangular tubular body for providing snug support in all direction for the mounting bar. A pair of bolts 366 extending cross ways to the elongate directions of the mounting bar 160 and the mounting bar receptor 364 hold them together. They extend through bolt holes in the bottom wall of the mounting bar receptor 364 and are threaded into aligned threaded bores in the mounting bar 160 to releasably hold the mounting bar 160 against sliding removal from within the mounting bar receptors 364. The mounting bar 160 is preferably made of machine finished aluminum bar stock and has a rectangular cross section with dimensions of 1"×3".

Figure 35:
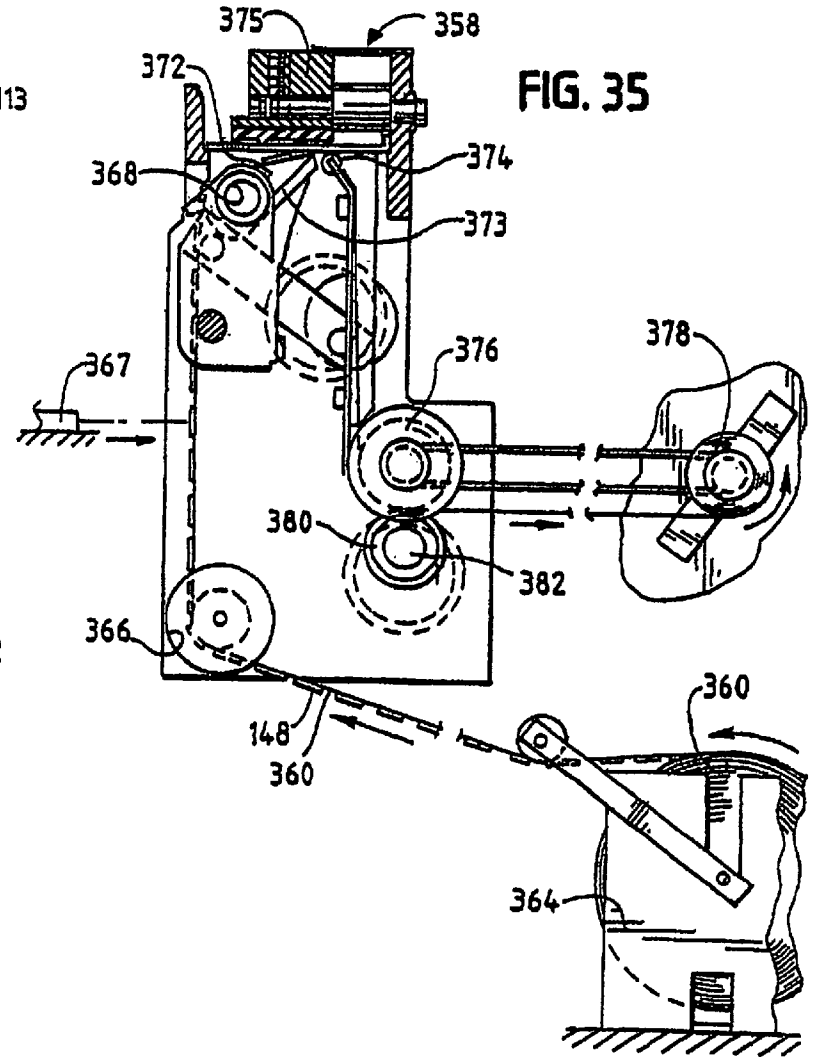
FIG. 35 is a side elevational, cross sectional view through section line 35—35 of FIG. 34 showing the label attachment station with the label roll feed and backing paper take-up reels and the variable label tape drive used to drive both reels.
Figure 34:
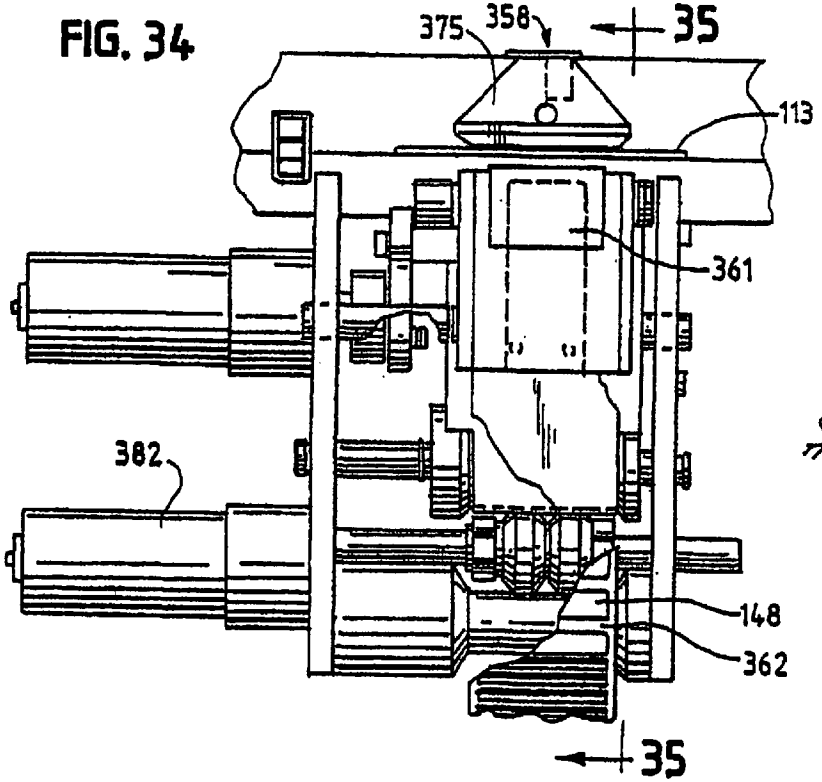
FIG. 34 is a front elevational view of the adhesive label attachment station at which the heat activated adhesive on one side of the adhesive label is attached to the back side of the card.
Figure 36:
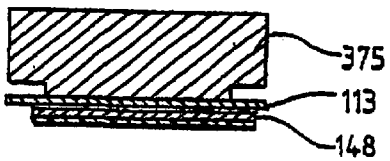
FIG. 36 is a cross sectional view of the counter member of FIG. 35 that holding the card down while the adhesive label is being applied.

Referring to FIGS. 34, 35 and 36 the label attachment station 358 heats and then attaches the heat activated adhesive side to each of the cards 128 prior to dropping the card onto the carrier 113. The double adhesive sided labels 148 are adhered to a roll 360 of backing paper 362 by pressure sensitive permanent adhesive. The outwardly facing side of the labels bear a coating of heat activated adhesive that is used to attach the labels to the cards 128. The adherence of the heat activated label 148 to the card 128 is stronger than the adherence of the other side of the label to the backing paper, and once the label is attached to the card movement of the card away from the backing paper removes the label from the backing paper. After the label is attached to the card, the card is passed to the card drop location for attachment to the carrier as explained above.

Figure 40:
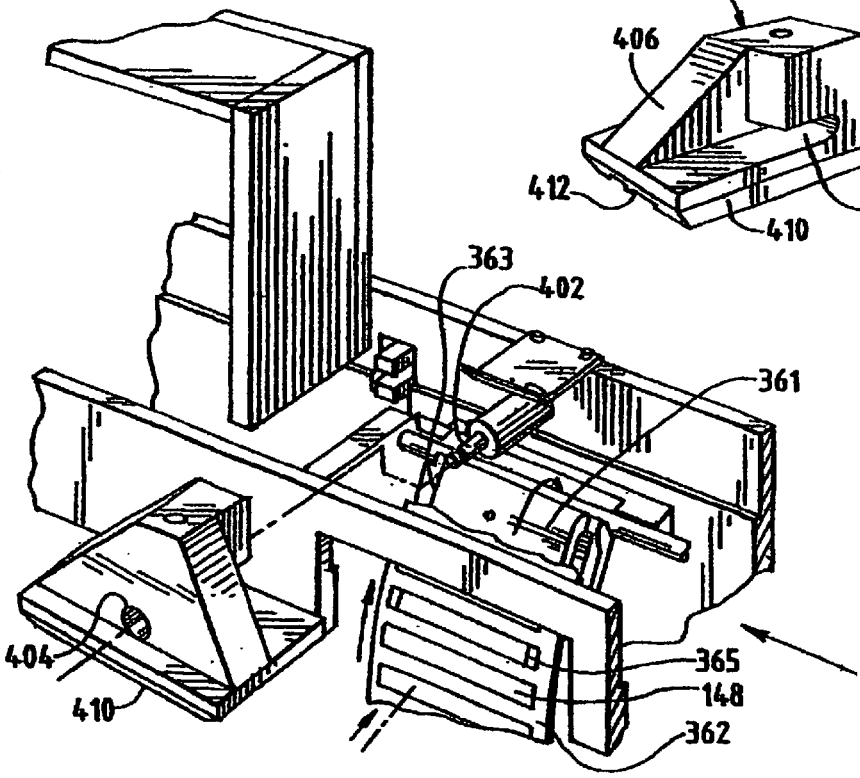
FIG. 40 is a perspective view of the label attachment station showing the manner of manual removal of the card retention member of FIG. 39, and with a portion broken away to show the heating platen with offsets on the sides that are spaced from the opposite ends of the label to create a heating "dead zone" on the opposite ends of the label to facilitate the removal of the label from the card after attachment.

Referring to FIG. 35, the full roll 360 is mounted for rotation within a roller caddie 364 and passes around a roller 366 and over the label pressing member 372. A heating element 373 at the underside of the pressing member heats at least two labels to activate the heat activated adhesive on the label immediately before being pressed onto the card. Importantly, as seen in FIG. 40, the heating platen 361 over which the labels travel have offsets 363 on opposite sides at which the labels are not heating leaving adhesive "dead zones" 365 on opposite sides of the label at which the adhesive is not activated and will not adhere to the card. It has been determined that these dead zones facilitate removal of the label from the card. As seen in FIG. 40, the labels are heated through the backing paper 362. The pressing member 372 presses the heated adhesive label against a card 113 at the attachment position by pressing against a side of the backing paper opposite the heated adhesive label and opposite the heat activated adhesive.

A removably mounted, pivotal, counter member 375 holds the card down against upward pressure from the pressing member 372, as shown in FIG. 36. A photosensor 367 senses the presence of labels between the roller 366 and the roller 368.

After the label has been attached to the card the backing paper alone is routed over a roller 374 and a driven roller 376 and wrapped around a driven take-up reel 378. The roller 376 is driven by a drive roller 380 powered by an electrical drive motor 382. The backing paper tape is squeezed between the drive roller 380 and the driven roller 376 and is driven toward the take up reel 378. At the same time a pulley 384 connected between the driven roller 376 and the take up reel 378 rotates the take up reel 378. The pulley 384 has a smooth circular cross section that facilitates clutch-like slippage when the roller 376 and the reel 378 rotate at different speeds due to the increasing diameter of the roll of spent backing tape on the take up reel 378.

Also, importantly, the 361 has a length sufficient to heat two labels 148, simultaneously. It has been determined that the additional heating time is needed to insure good activation of the heat activated adhesive.

Figure 37:
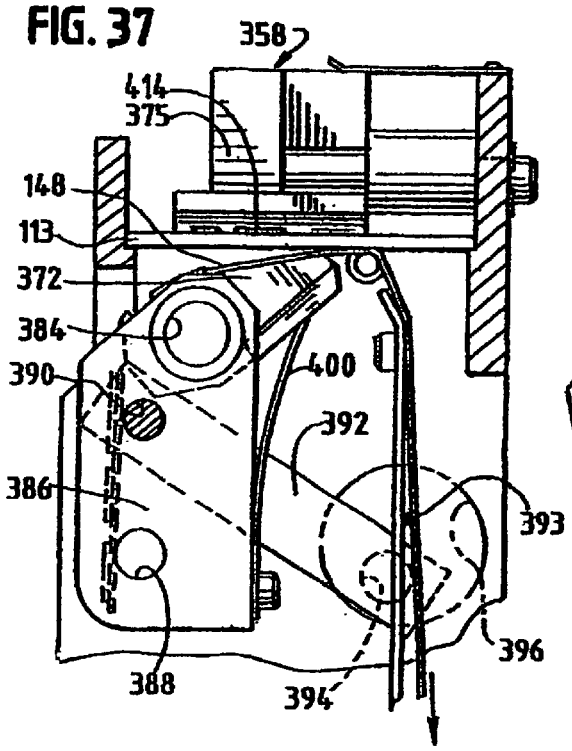
FIG. 37 is an enlarged side view of the label attachment station of FIG. 35 with the label attachment finger in a position at which the heated label is first pressed against the card during the card attachment stroke.
Figure 38:
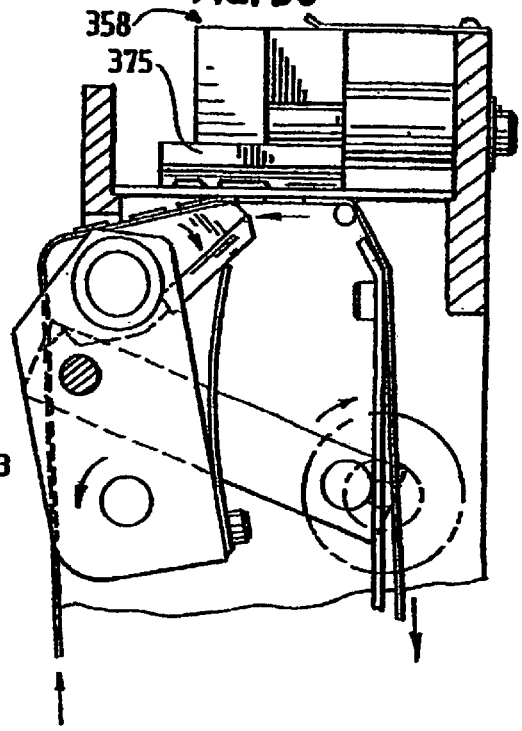
FIG. 38 is an enlarged side view similar to that of FIG. 35 but with the label attachment finger in another position at the end of a card attachment stroke after the label has been swiped onto the back of the card.

Referring now to FIGS. 37 and 38, it is seen that the movement of the pusher member is not merely pushing but is pushing while sliding across the surface, i.e. the adhesive label is swiped onto the card with the pusher member 372. The pusher member 372 is pivotally mounted for rotation about a pivot axis 384 at the end of an arm 386. Arm 386, in turn, is mounted for pivotal movement about a pivot axis 388. The arm 386 is also pivotally attached at a pivot axis 390 to one end of a drive link 392. The other end of the drive link 392 is pivotally mounted to an eccentrically mounted post 394 on a rotating disc 396. The rotating disc 396 has a central rotary axis 398. The disc is driven by an electrical control motor. The pressing member 372 is spring biased toward counter-clockwise toward the card 113 by a leaf spring 400. Accordingly, as the disc rotates from the position shown in FIG. 37 to the position shown in FIG. 38, the end of the arm moves the pusher member across the label while the leaf spring 400 and pivotal connection of the pusher member allows the pusher member to pivot as necessary to slide along the surface of the back side of the tape and card.

Figure 39:
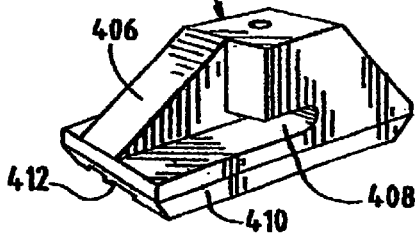
FIG. 39 is a perspective view of the pivotably and manually removably mounted, card counter member, or card retention member, preveiously shown in cross section in FIG. 36 which holds the card down against the upward force of the label attachment finger during the card attachment stroke.

Referring now to FIGS. 39 and 40, the counter member 375 is mounted for pivotal rocking movement to a post 402 that is removably received within a mounting bore 404 that passes through a front section 406 of the counter member 375 and communicates with the end of a horizontal slot 408. This slot enables tool-less mounting and dismounting of the counter member 375 to the pivot post 402 with the bottom surface 410 in adjacent, counter-pressing relationship with the card 113 while still permitting a small amount of rocking motion. The counter member is attached by first laterally sliding it along the card track until the bore 404 is aligned with the pivot post 402 and then pushing it onto the post 402. The rocking motion is needed to facilitate the movement of the top of the embossed card beneath the bottom surface 410. The bottom surface is preferably TEFLON coated to minimize friction between the bottom surface 410 and the card 113. Also, the card receiving end 412 is canted to guide the top surface of the card beneath the bottom surface 410 of the counter member. In addition, to accommodate the raised embossed alphanumeric letters (not shown) at the front of the card, the counter member 375 has upwardly extending slots 414, as seen in FIGS. 37 and 38, that are aligned with the standard embossed character locations on the card 113.

During application of the labels 148, the platen 361 is maintained at an average temperature of no less than 200 degrees Farenheit and the labels are engaged with the platen for no less than 1000 milliseconds. The pressing member 372 presses the label against the card within no less than 500 milliseconds of the label leaving the heating platen and takes 500 milliseconds for one label swipe cycle.

Figure 41:
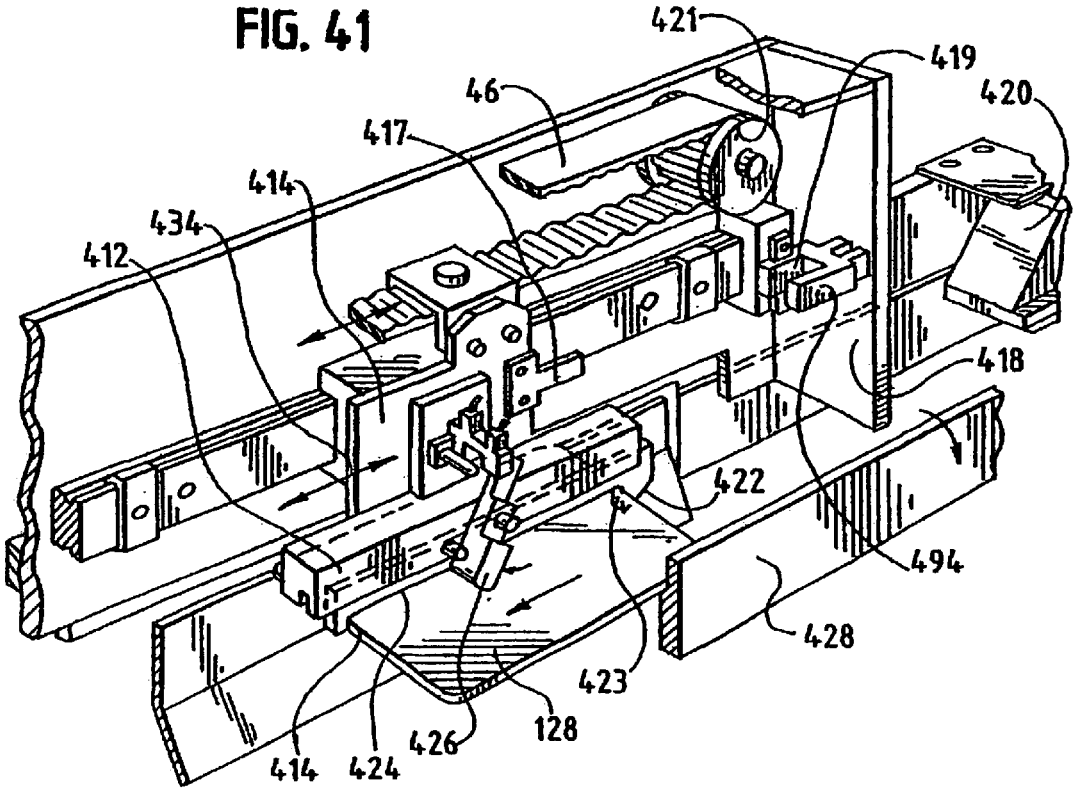
FIG. 41 is a perspective view of a card sled section of the card transport mechanism, or card track, that moves the card with the attached label to a card drop position at which the card is dropped onto the matching carrier.
Figure 42:
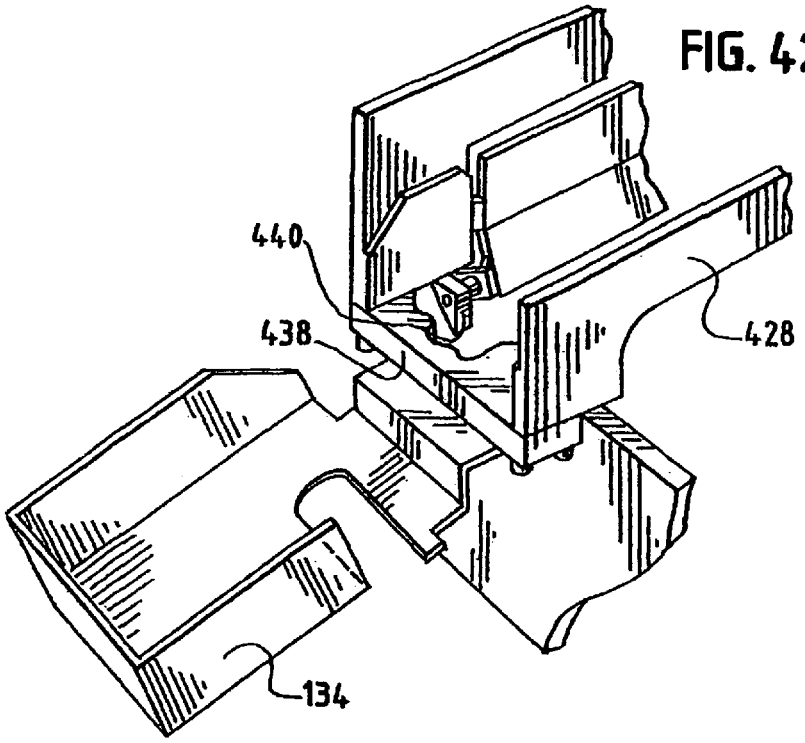
FIG. 42 is a perspective view of an end of the card track with a card reject bin to receive cards that have been rejected and have not been dropped onto a carrier at the card drop position.

Referring to FIGS. 41 and 42, the card transport path 166 includes a portion that is downstream of the label attachment module 358 referred to as the card shuttle 412. The card shuttle 412 is mounted via a pulley mount 414 to a pulley 416 driven by a shuttle pulley motor, FIG. 47. At the beginning of each card shuttle cycle, the card shuttle is located against a wall 418 at a shuttle home position and awaits receipt of a card 128. The presence of the shuttle at this home position is sensed by a photosensor 494, FIG. 47, when a sensor tab 417 is received within a mating slotted member 419 at the wall 418. The card 128 is pushed along the card track 166 by a card pusher 420 and at the same time read with readers of various types and compared to data to make sure the card is the correct card for the carrier. The details of how this pusher is moved, the part of the card track 166 down which it moves and the reading of the card during this portion of the cycle does not form a part of the present invention, and is substantially like the card path and reading and verifying system as shown and described in the aforementioned U.S. patent application Ser. No. 09/081,132, which is incorporated by reference.

Further details concerning cards and their manufacture and insertion into carrier that are needed to understand any of the part of the system 100 that have not been disclosed in detail may be had by reference to the following patent, which are hereby also incorporated by reference: U.S. Pat. Nos. 5,494,544; 4,034,210; b1 4,194,685; 4,429,217; and 5,388,815.

When the leading edge of the card 128 engages the beveled guide surface 422 of a card shuttle pusher member 423, the card is cammed downwardly, being a resilient plastic, and then snaps back up to ride along an upper edge 424 of the card shuttle 412 until it engages a downwardly extending card stop 414. At that point, the lagging edge of the card 128 is received in front of the card shuttle pusher member 423 and nestles within the card shuttle between the pusher member 423 and the stop member 414 and is tangent along its top surface with the downwardly facing card engaging surface 424 of the card shuttle 412. As it passes a sensor arm 426 the presence of a card nestled within the card shuttle 412 is detected and reported to the controller. The card 128 is then moved by the shuttle 412 to the preselected card drop location, at which point the removable card support member 428 is pivoted out of supporting relationship with the card 128 and is dropped onto the carrier 113.

Advantageously, unlike known card movement mechanisms, the card shuttle captures the card 113 between the card stop 414 and the inner wall of the card shuttle pusher member 423. Accordingly, the card shuttle is capable of moving the card in either of two directions and not only in the direction of normal travel indicated by arrow 434. The card shuttle is capable of moving the card to any selected drop location to drop the card at any selected location on the carrier. In keeping with on aspect of the invention the card track is moved by means of an encoded motor that drives the pulley 416. The controller first applies full power to the shuttle to accelerate the card toward the desired drop location, but then when the encoder signal indicates that the selected location is near power is reduced and the speed of the shuttle is slowed to prevent over travel due to the momentum of the card shuttle at the higher speed. After the card drop, the shuttle 412 rapidly returns to the home position in which a T-shaped member 436 is received within a mating slot of a sensor member 438. Once the shuttle is sensed being at the home position, the pusher 420 is actuated to load the next card into the shuttle 412.

Turning now to FIG. 42, in the event the card 128 is determined to be defective, then the shuttle 412 continues past any possible card drop location and to an open end 438 of the card track portion 172, FIG. 7. The underlying support of the card 128 is lost at the end, and the card 128 slides into the card reject bin 134. A sensor 440 senses the passage of the rejected card to the reject bin and the controller responds by recording the reject and information relating to the rejected card.

Figure 43:
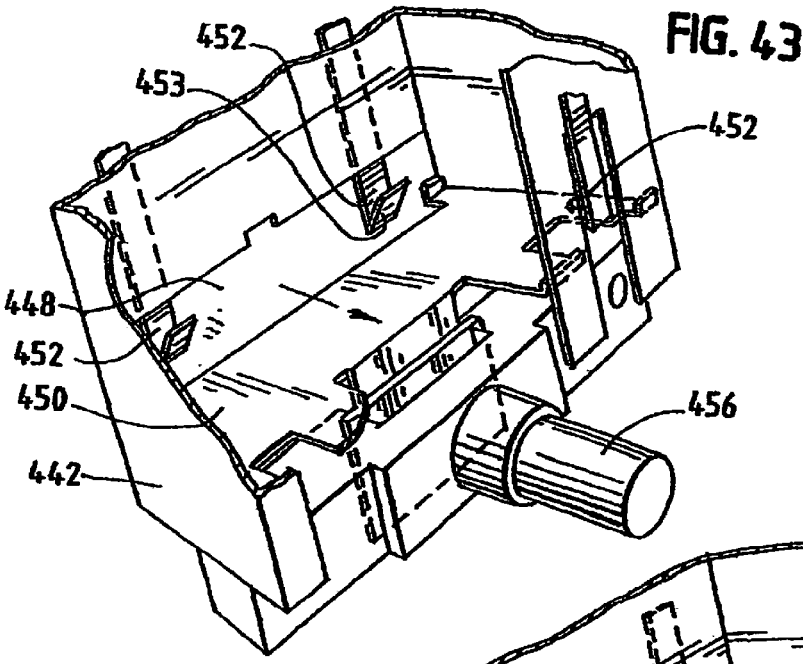
FIG. 43 is a perspective view of the FIFO card package stacker that stacks the completed card packages in which newly completed card packages are inserted at the bottom of a stack of completed card packages and earlier completed card packages are located at higher positions on the stack, with a stack pusher being in a first position awaiting the card package to be laterally inserted into a loading position beneath a stack inlet opening.
Figure 44:
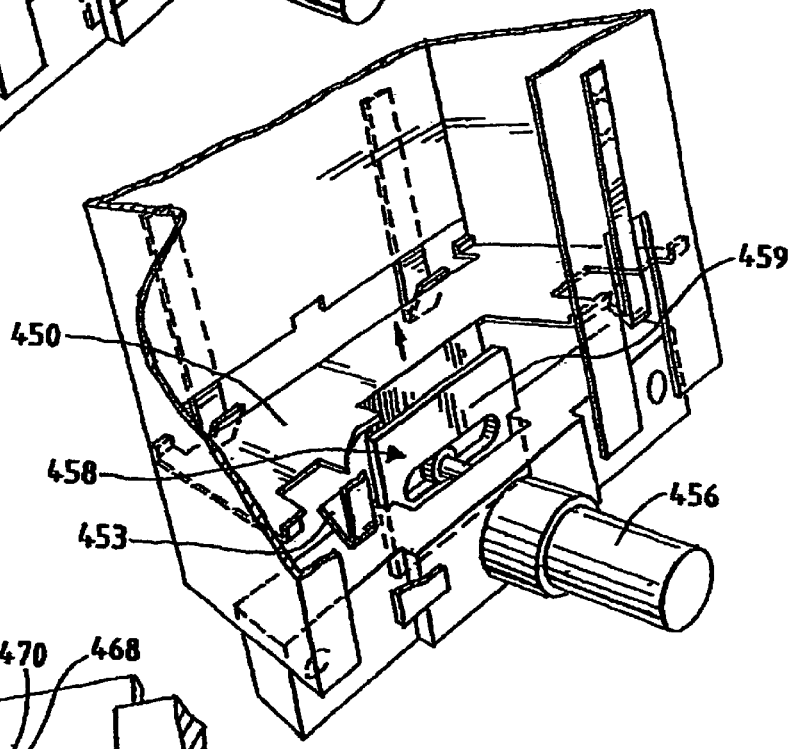
FIG. 44 is a perspective view similar to that of FIG. 43 but with the stack pusher in a relatively elevated position to push the card package through the inlet opening and past the underlying resilient.
Figure 45:
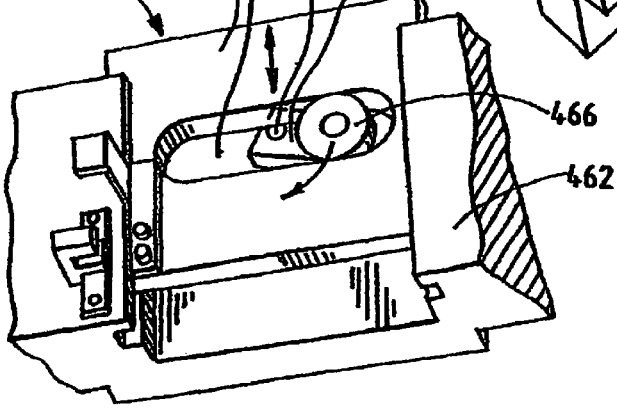
FIG. 45 is a an enlarged perspective view showing the drive linkage for the stack pusher.

Referring now to FIGS. 43, 44 and 45, the FIFO stacker module 146 is seen to include a rectangular, tubular stacking frame, or housing, 442 within which the card packages 115 are stacked. The stacker module 146 also has open top 444 and an elongate finger slot 446 to facilitate removal of the card packages 115 from the stacking frame 442, as best seen in FIG. 1.

The card packages 115 are passed through a bottom opening 448 adjacent the bottom of the stacker frame 442 by a set of rollers 284, as shown in FIG. 26, when a card package is selected for stacking and the stacker gate 280 has been activated. The card packages 115 are placed on top of a stacker pusher plate 450 when the pusher plate is in a home position as shown in FIG. 43. In the home position the pusher plate is located beneath a set of four, substantially identical resilient support members 452 to allow for passage of the card package beneath the support members 452. Each of the support members 452 is made of spring steel and have inwardly and upwardly projecting support tab 453. Two of the support members 452 are on the back side, and the other two are located on the front side directly opposite the two on the back side. The distance between the opposed card package support tabs 453 on opposite sides is less than the width of a carrier package 115.

After a card package is inserted into the opening 448, which is sensed by a card stack sensor 454, FIG. 26, and is resting atop the pusher plate 450, a pusher plate motor 456 raise the pusher plate in the direction of arrow 458 from the home position shown in FIG. 43 toward a loading position, as shown in FIG. 44. When the loading position is reached, the carrier package 115 is elevated by the plate 450 above the card package support tabs 453. Any card packages already in the stack are also raised at the same time to make room for the latest card package to be added to the bottom of the stack. The stacker plate 450 is then lowered to the home position while the card package it was previously carrying remains at the bottom of the stack and supported by the four card package tabs 453. Thus, as the card packages 115 are added to the bottom of the stack, one package at a time, the stack is moved upwardly toward the open top from which they the first card package of a run is advantageously located on top. The first card package into the stacker is the first one to reach the open top 444, FIG. 1 and may be easily removed.

The movement of the stacker plate is achieved by means of a linkage 459 also shown in FIG. 45. A pusher link 460 is supported for sliding movement within support tracks of a support member 462. The linkage has a slot 464 within which is slideably receive a metal pin roller 466. The roller 466 is attached to the end of a crank arm 468. The crank arm 468 is driven by the motor 456 to rotate about a rotary axis 470, and as the crank arm rotates, the linkage 459 moves up and down with the up and down movement of the the pin roller 466 within the slot 464. A sensor 472 detects when a detection member 474 attached to the linkage 459 and thus the linkage have reached the home position so that another card may be inserted through the lateral load opening 448 and placed into loading position.

Figures 46, 47:
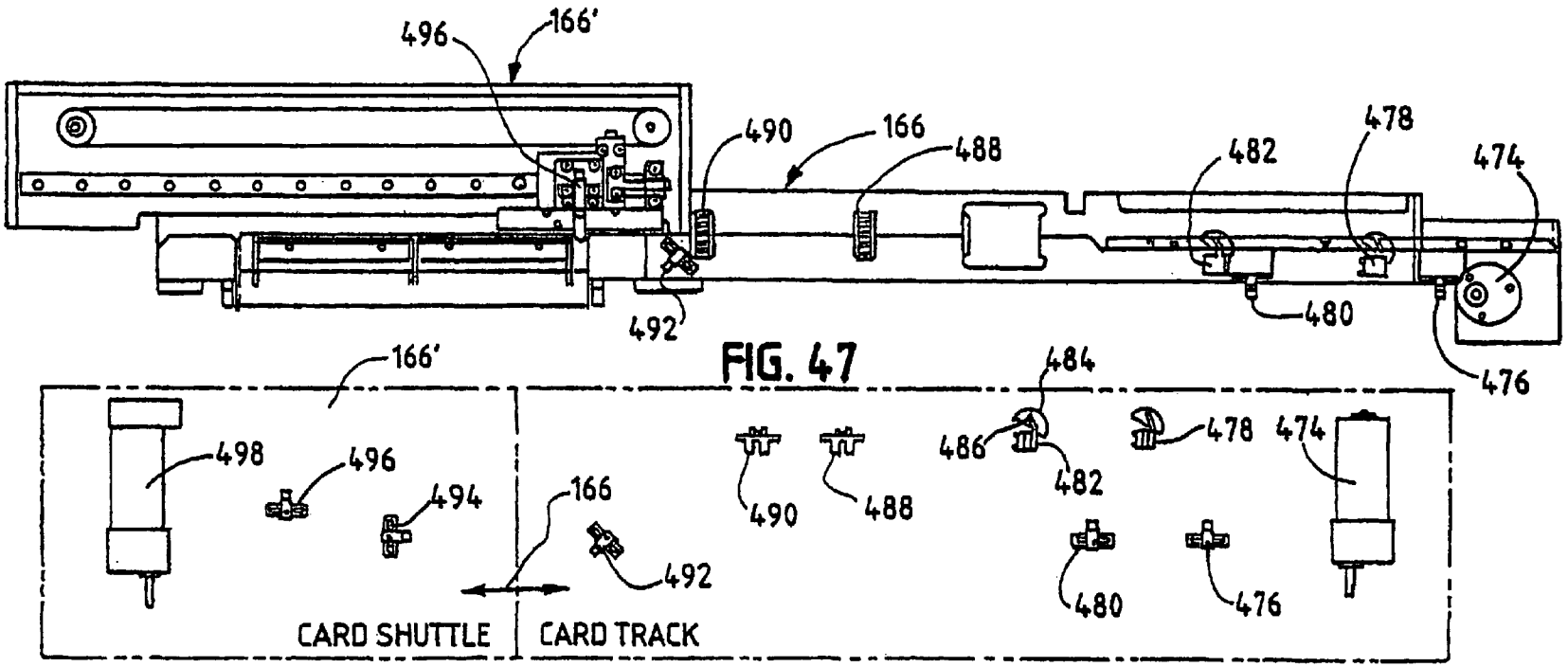
FIG. 46 is a schematic side view of the card transport track from the card track inlet to the card reject bin.
FIG. 47 is a schematic illustration showing the relative locations of the sensors and drive motors associated with the card transport path.

Turning now to FIGS. 46 and 47, the card transport track 166 including the card shuttle section 166' is seen to include a plurality of servo motors and sensors some of which are not well seen in the other drawing figures. The relative location and of these card track elements are schematically shown in FIG. 47. The controller, that will be described below receives information from the sensors and use such information to control the application of power to motors. Starting from the beginning of the card track 166 on the right, the first motor is a card pusher motor 474 which powers a card pusher to push a card dropped onto the card track from a card hopper 144, FIG. 1. Next, there is a first "pusher home right" sensor 476 is a photosensor that detects when the pusher is in a first home position on the right and is ready to receive a card from the right hand card drop location of the right hand side of the two card stack hopper 140. The card is dropped on the left of the right home position to push the card to the left. The "card dropped right" proximity switch sensor 478 has detects when the card has been dropped to the right side card drop location and is in position to be pushed down the card track 166. The next "pusher home left" photosensor 480 performs the same function as the sensor 476 but does so for the left home position for pushing cards dropped from the left side of the dual stack card hopper from the left home position. Likewise, the "card dropped left" proximity switch sensor 482 senses when a card has been dropped to the left side card drop location.

Advantageously, the proximity switch sensors 478 and 482 have rounded caps attached to the conventional actuation levers 484 to protect the levers 484 against damage in the event a card is inadvertently moved across the lever in a direction opposed to its normal direction of movement.

The next sensor is the "reading position" photosensor 488 which detects when the card is in position at the beginning of a portion of the track at which data is read from the card and compared to the data base and to the information carried by the carrier.

The following sensor is the "labeling position" photosensor 490 which detects when the card 128 is in position for receipt of an adhesive label 148. This is followed by a "pusher away" photosensor 492 that detects when a card pusher (not shown), has moved from its home position.

The remaining elements of the card track 166 are on the card shuttle portion 166'. The first sensor is the "shuttle home" photosensor 494 as also seen in FIG. 41 which detects when the shuttle 412 is in the home position when the tab 417 is received within slot 419, FIG. 41. The last "card present" sensor 496 detects when the card the sensor arm 426, FIG. 41 has been moved to the detection position when the card becomes fully nested within the card shuttle. The shuttle motor 498 moves the shuttle pulley belt 416 by driving pulley wheel 421, FIG. 41.

Figures 48, 49:
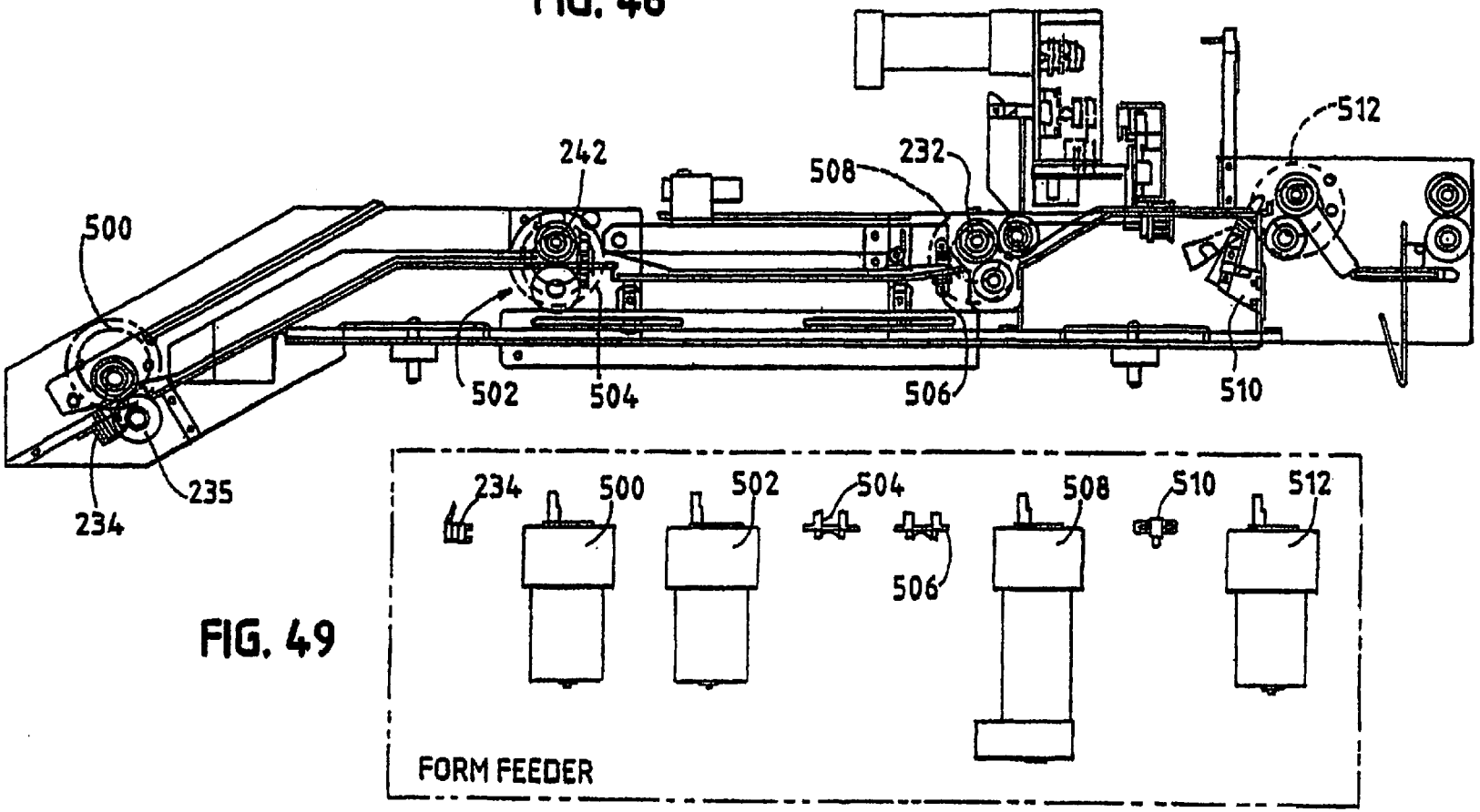
FIG. 48 is a schematic side view of the entire carrier transport path and from the inlet to the card folding station.
FIG. 49 is a schematic illustration showing the relative locations of the carrier sensors and carrier transport drive motors of the carrier transport of path of FIG. 48.

Referring to FIGS. 48 and 49, the first sensor along the carrier path 164 is seen to include the carrier inlet feed sensor 234, FIG. 12, which detects that a carrier 113 has been fed into the carrier inlet 126. This causes the carrier inlet drive motor 500 to drive the carrier inlet rollers 235 to move the carrier to the second set of rollers 242, FIG. 12, which are driven by the intermediate carrier drive motor 502. Next, a photosensor 504 detects when the carrier has emerged from the intermediate carrier rollers 242. Then a photosensor 506 detects when the carrier 113 is at the card attachment station in front of attachment rollers 252. These card attachment rollers are driven by the reversing motor 508. Next there is folding station photosensor 510 that detects when the partially folded carrier is being passed to the folding station rollers 258. These motors can also be seen in FIG. 11. All of the mechanically actuated proximity switches are preferably Model No. OP8850 made by OPTEK.

By controlling the above described motors based on the information sensed from the various sensors card package production system 100 is capable of attaching cards, up to six cards anywhere on the carrier 113. There is only room to mount two cards on each of the three panels but each panel can have two cards mounted for a total of six cards. If only one card is to be mounted to the carrier then it may be mounted in the middle of a panel. This ability is achieved by controlling the longitudinal position of the carrier relative to the card drop location when the card is dropped to select which of the three panels will receive the dropped card. On the other hand, the lateral position of the card on a panel is determined by what position along the card shuttle path 166' the shuttle is controlled to be when the card is dropped, there a plurality of card loading, or drop, positions located across the width of the carrier path.

The controller described below controls the card loading station to selectively laterally position the card across the width of the form and to selectively align one of the plurality of positions with the card loading station to longitudinally position the card along the length of the carrier.

Figure 50B:
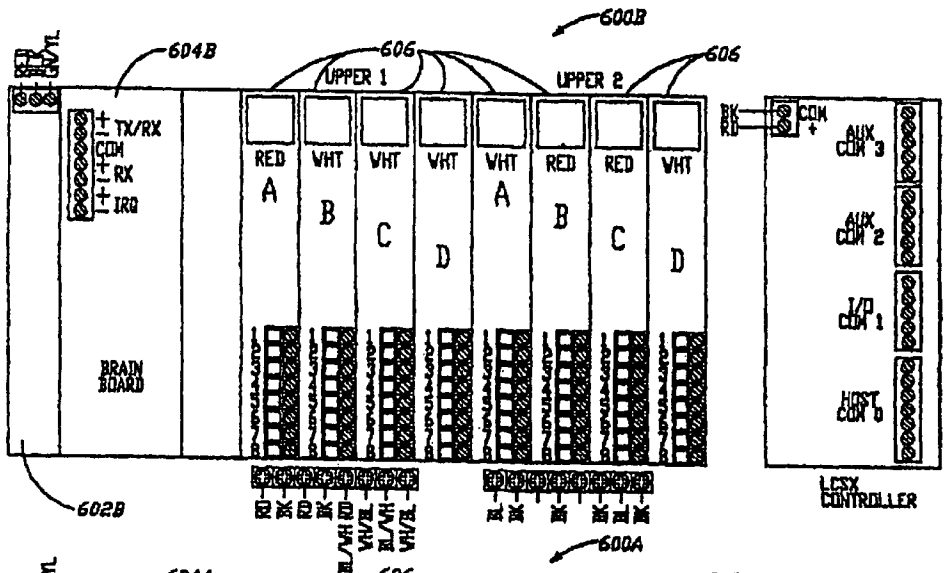
FIGS. 50A and 50B are elevational views of the control module arrays composed of a controller board, a brain board and a plurality of control modules used to control the system that is made by OPTO 22 described more fully below.
Figure 50A:
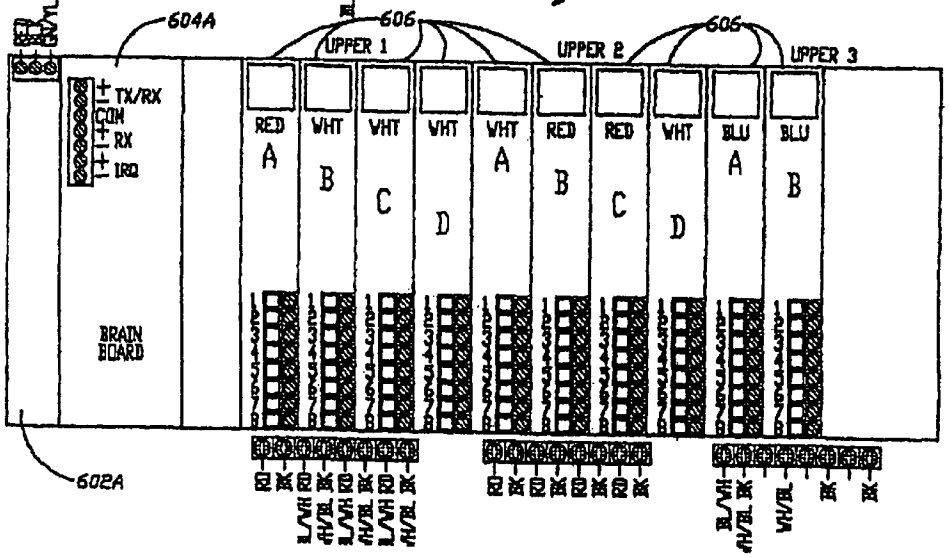

Referring now to FIGS. 50A and 50B the control system is seen to include an OPTO 22 model controller system made by OPTO 22 of Temecula, Calif. and having a web site at www.optto22.com. The OPTOCONTROL system has two brain boards 600A and 600B that interface an LCSX controller 605 with a plurality of control modules 606. The control modules interface with the sensors and the control motors. The controller, in turn, operates in accordance with the OPTOCONTROL programming flow chart. Pursuant to the OPTOCONTROL, the OPTOCONTROL software automatically generates the code needed to effectuate the flow chart. The actual code is attached as Appendix A.

Figure 51:
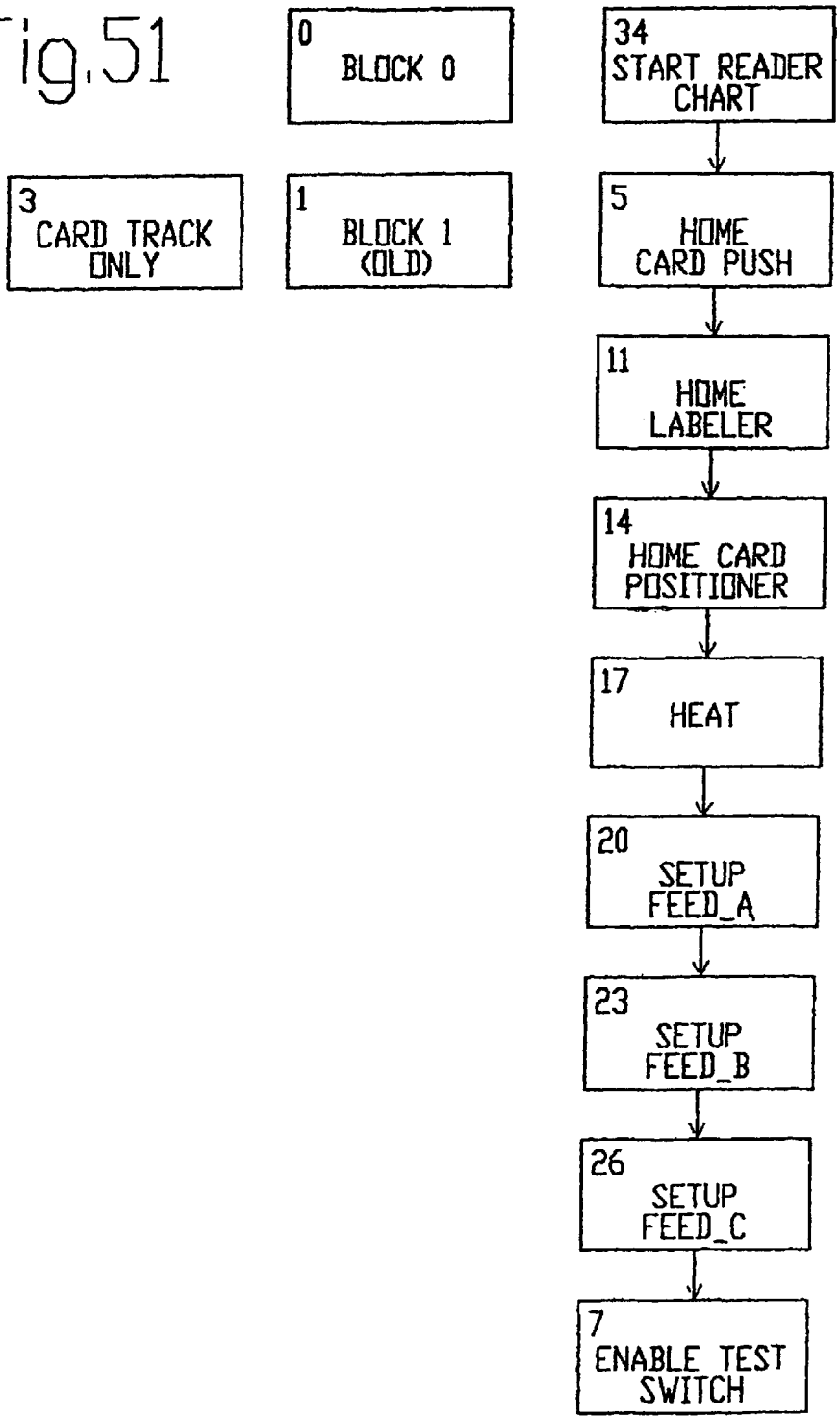
Figure 52A:
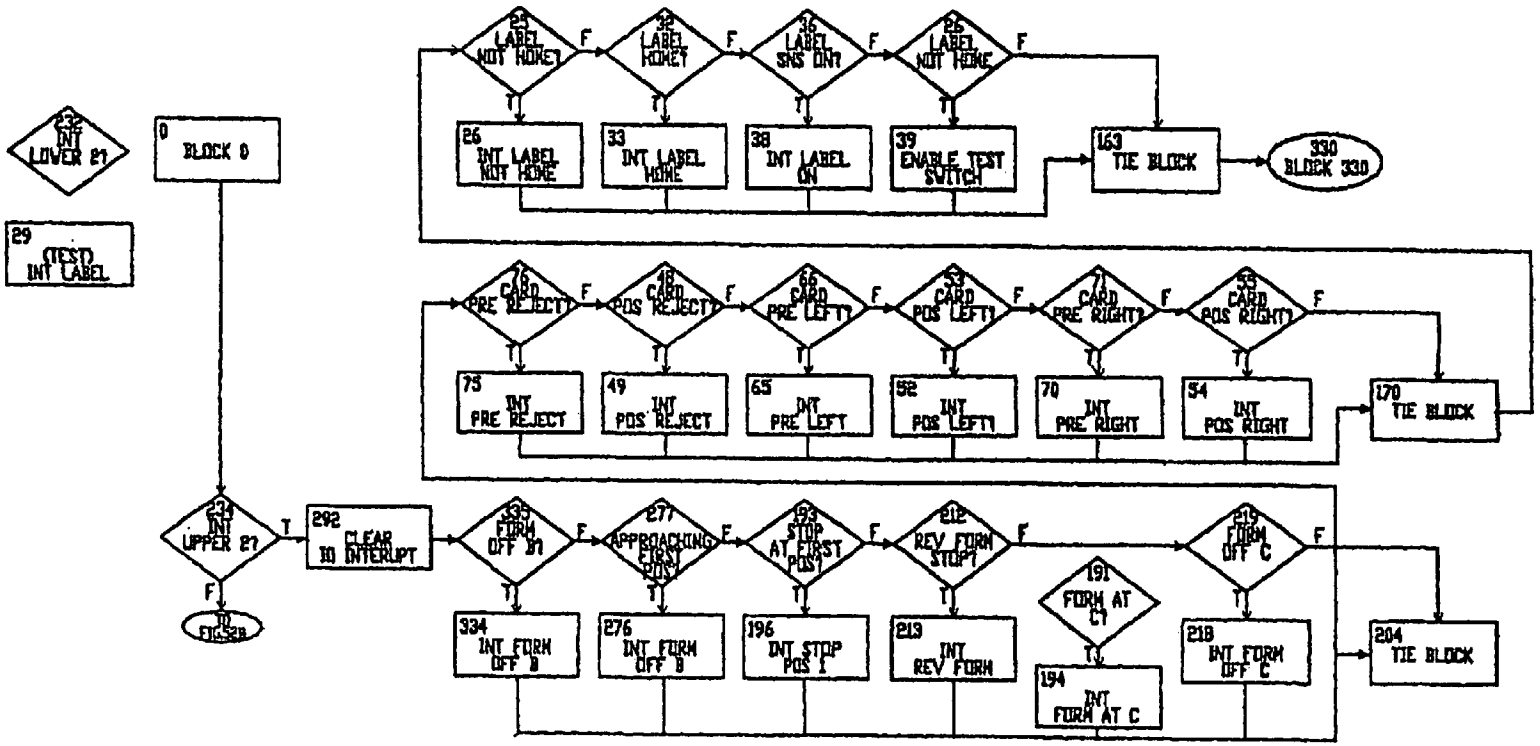
FIGS. 52A, B, and C. is a flow chart of the interrupt routine of the preferred embodiment.
Figure 52B:
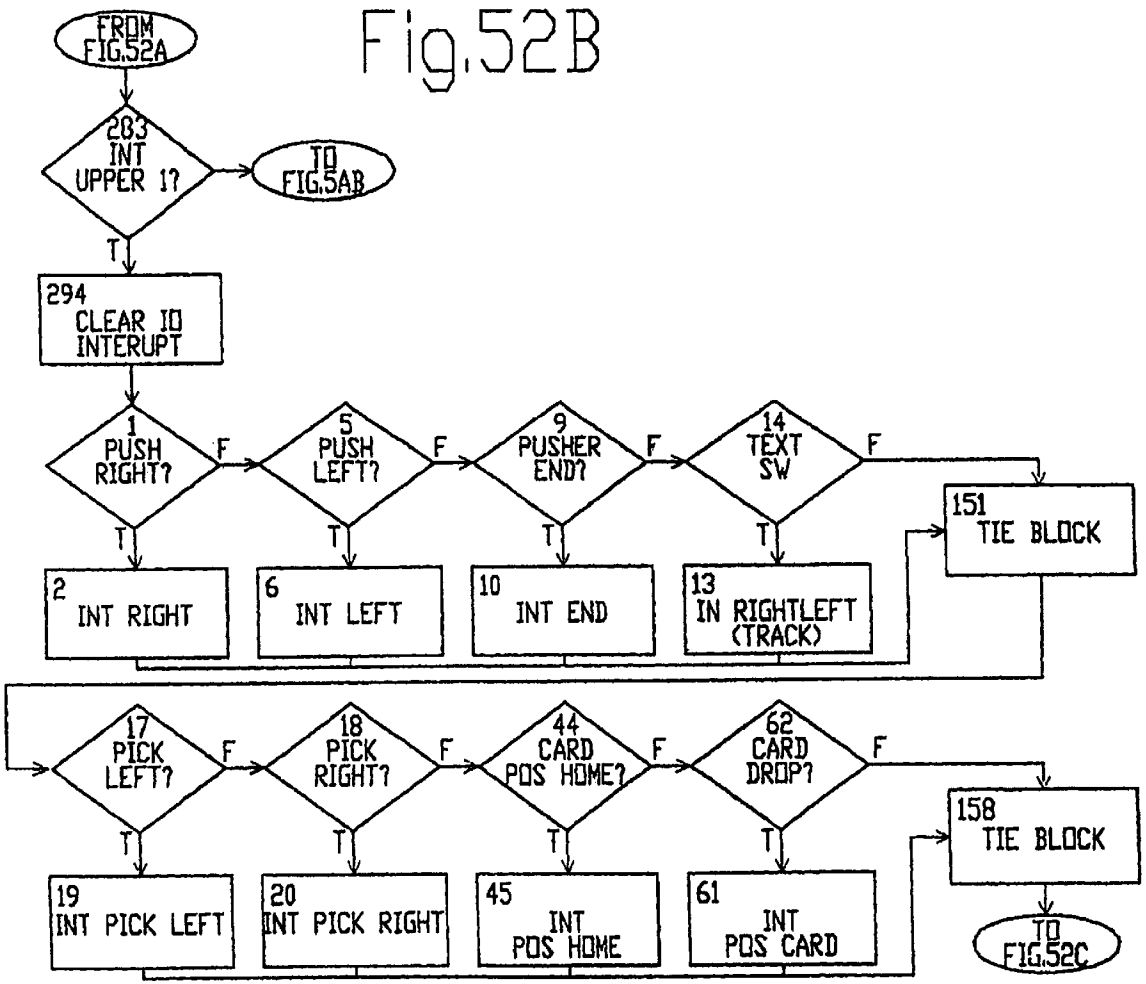
Figure 52C:
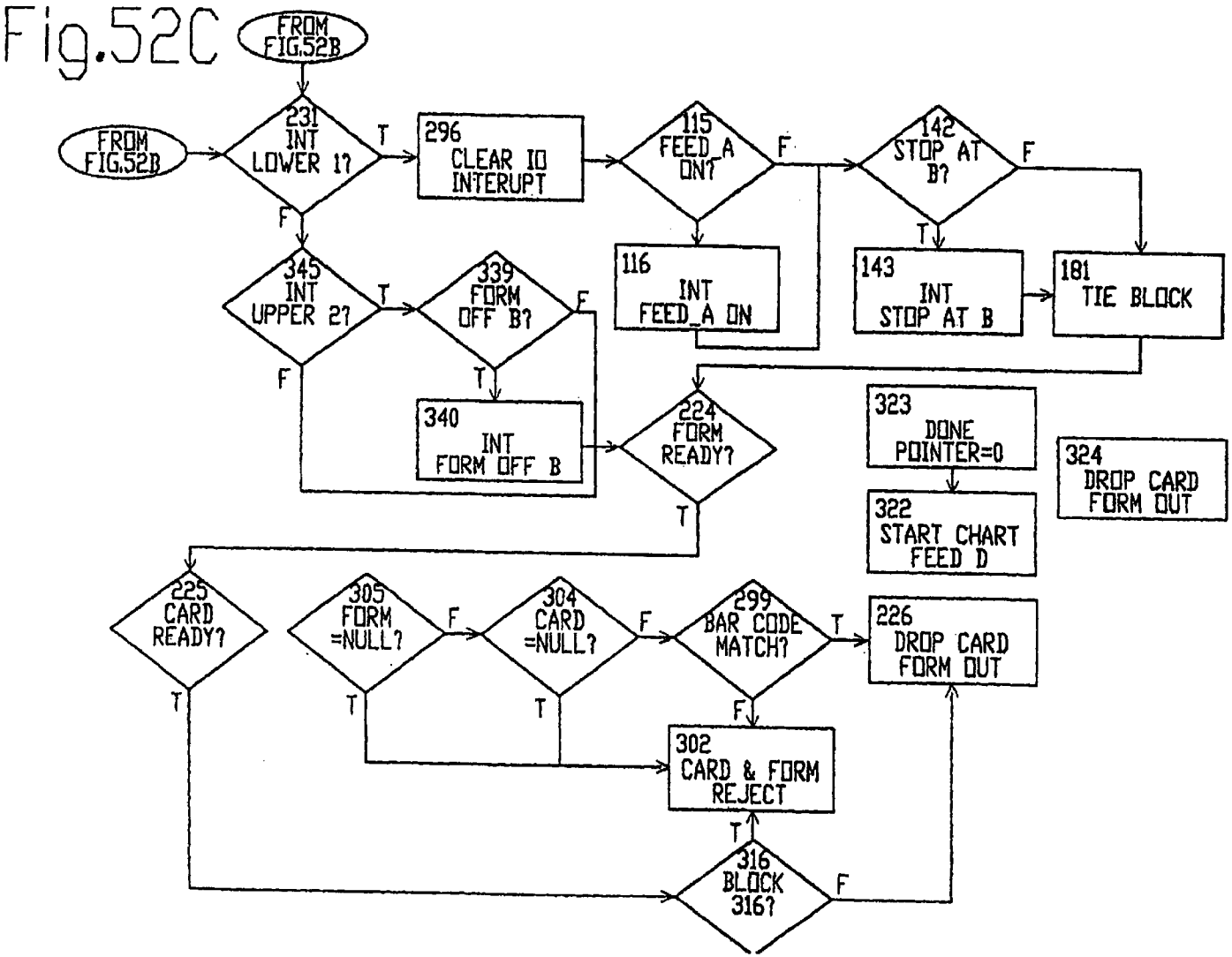
Figure 53:
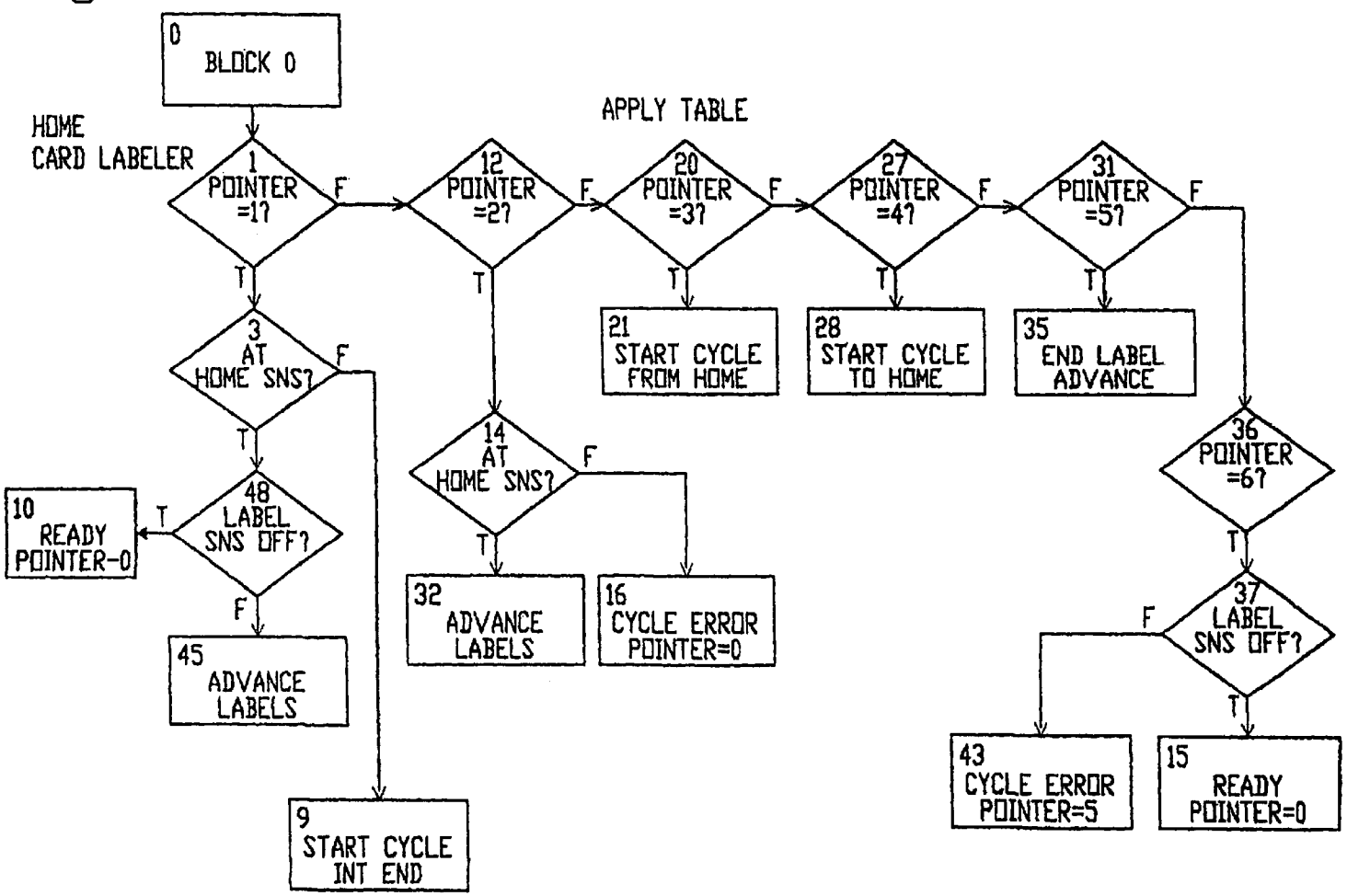
Figure 54:
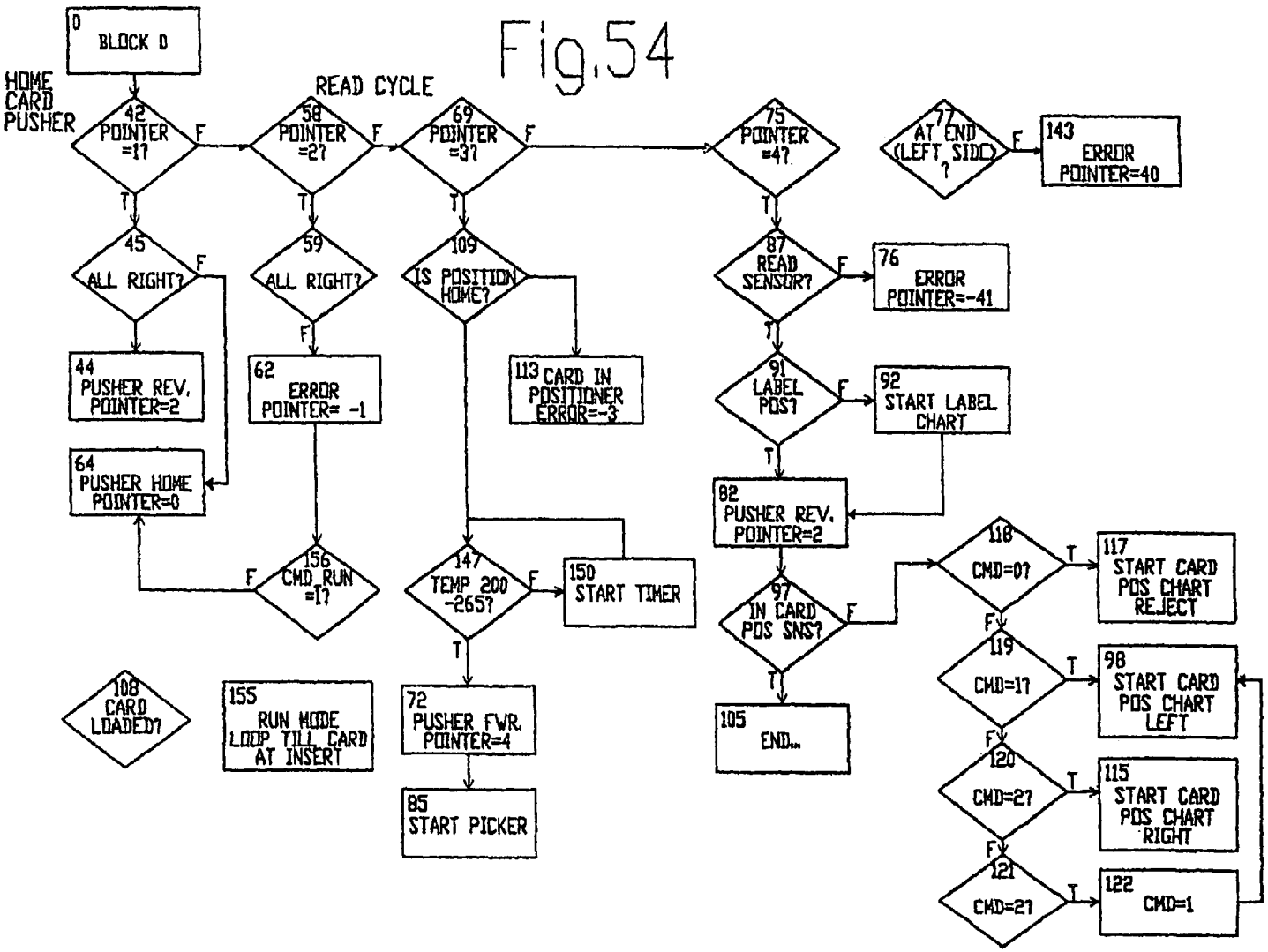
Figure 55:
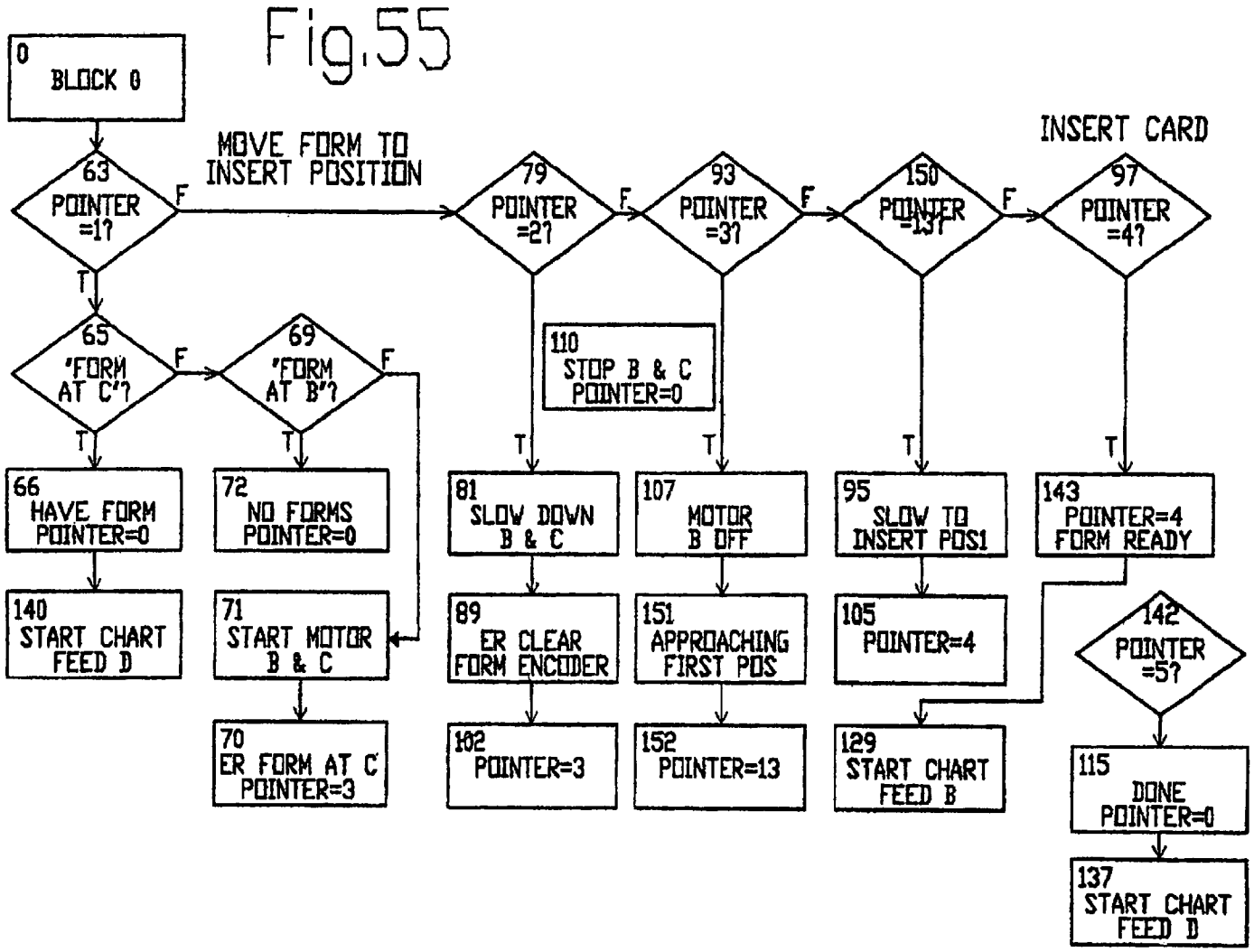
Figure 56:
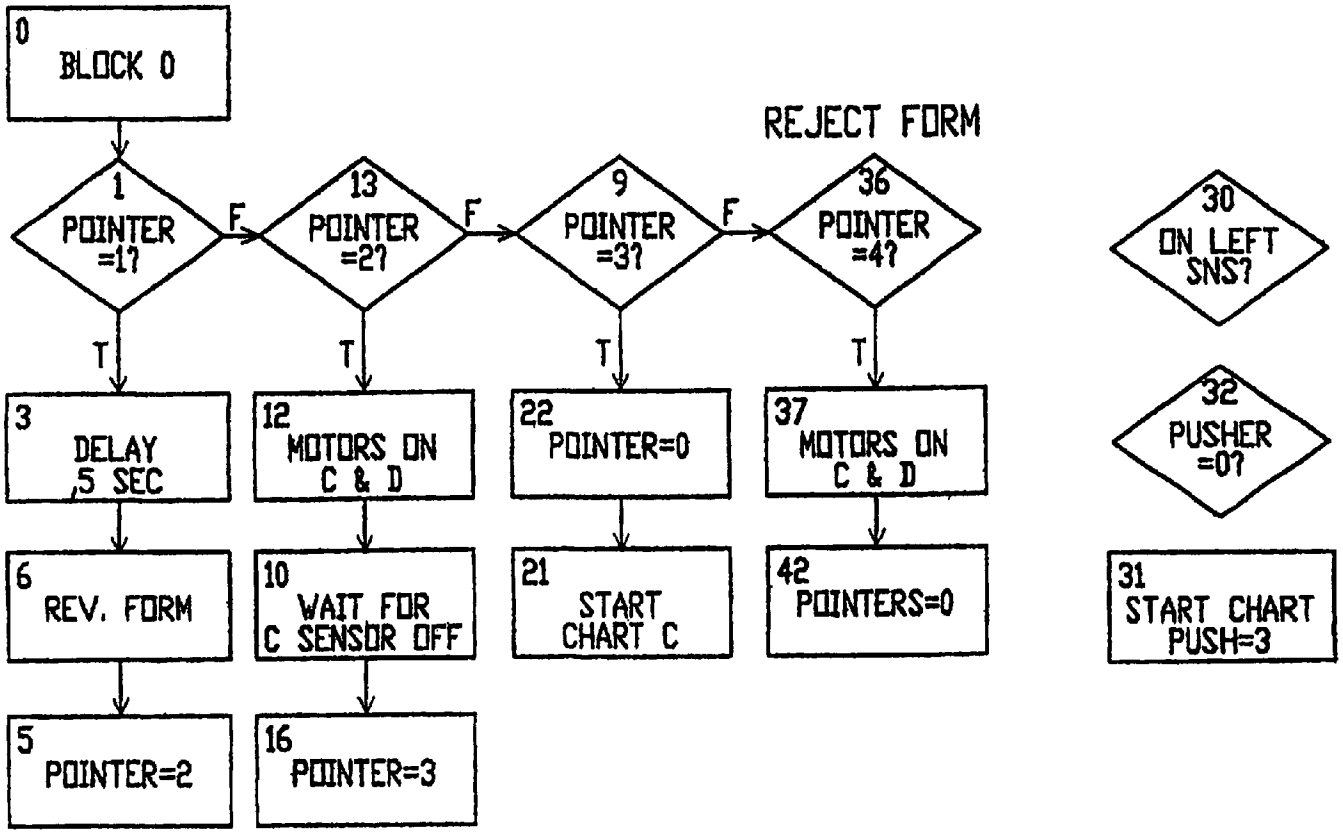
Figure 57:
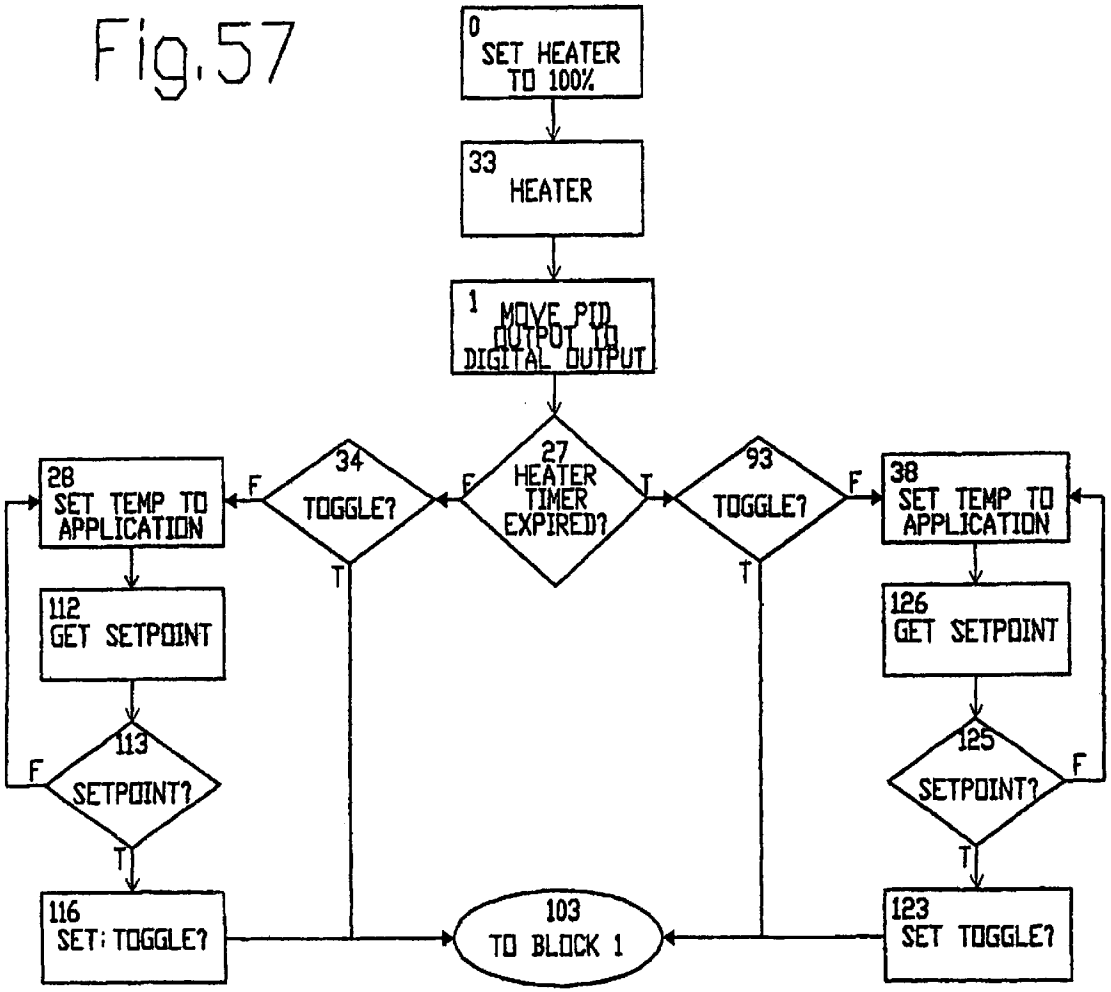
Figure 58:
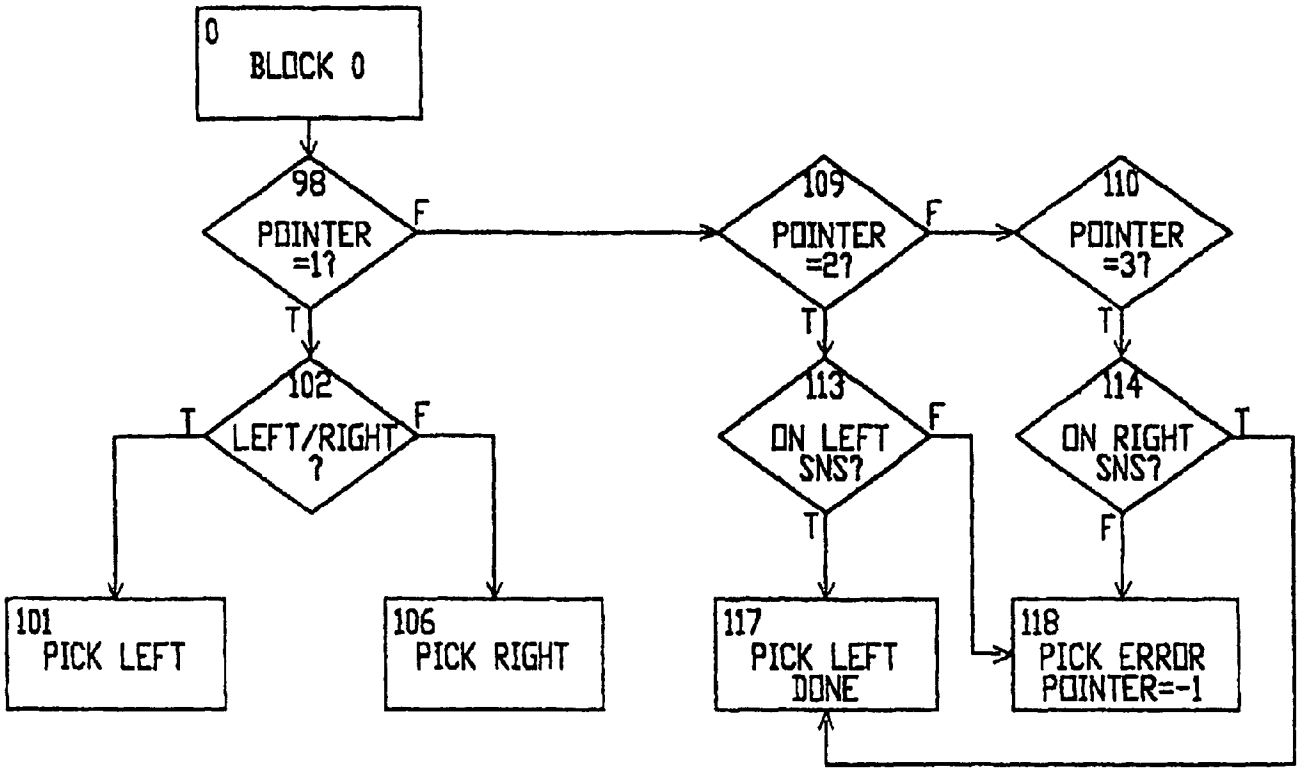
Figure 59A:
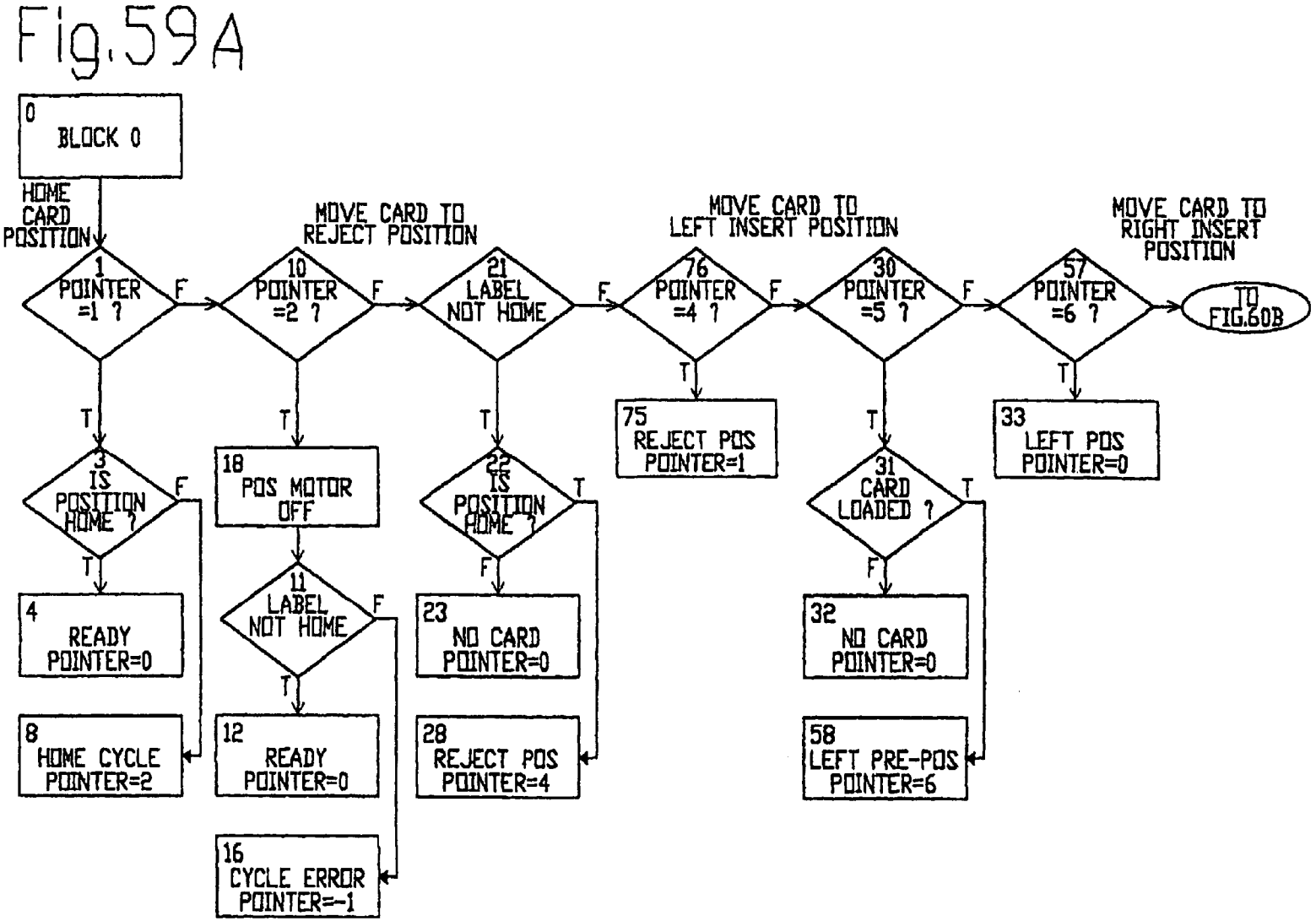
FIGS. 59A and B is a flow chart of the card position routine of the preferred embodiment.
Figure 59B:
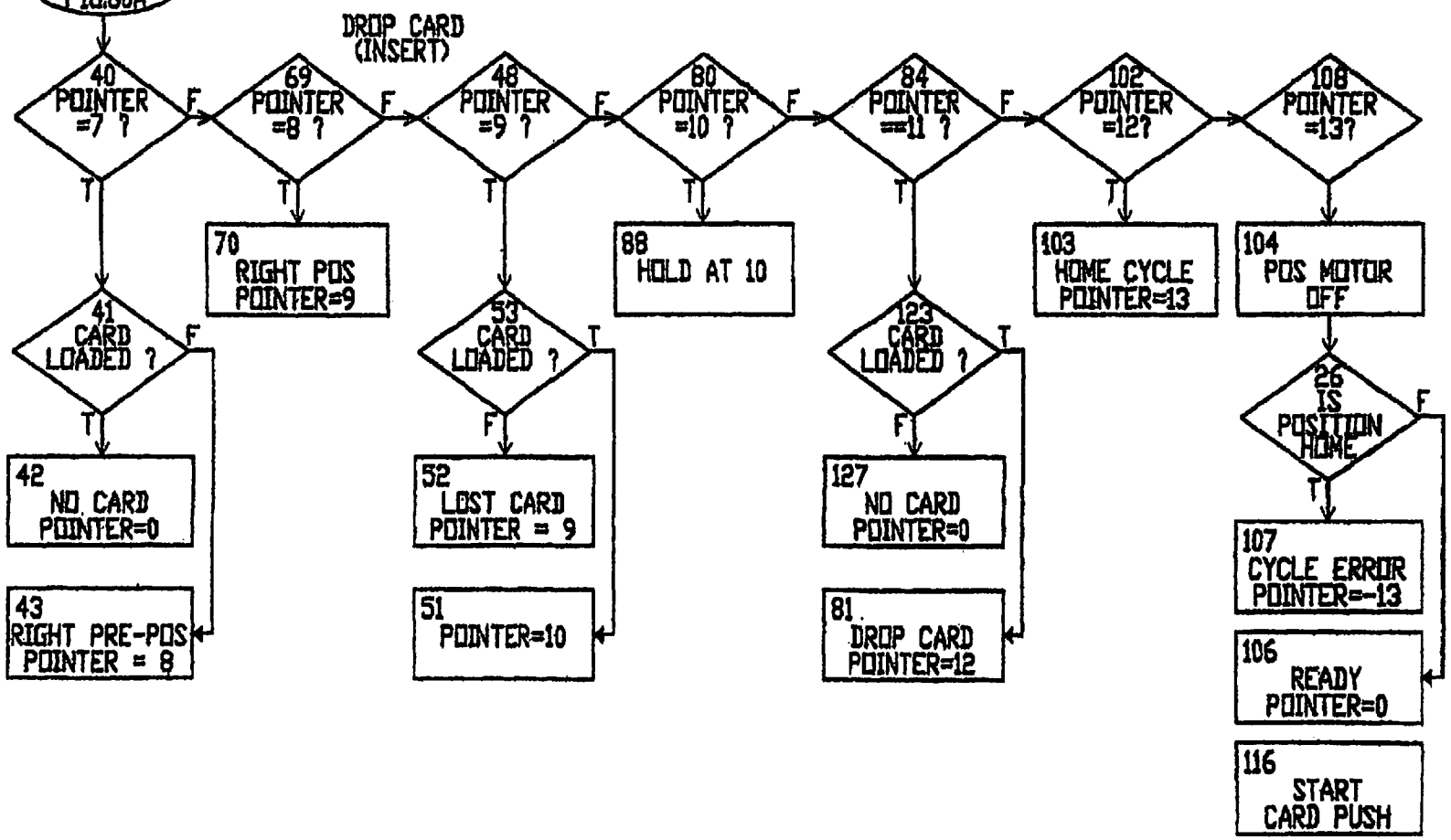
Figure 60:
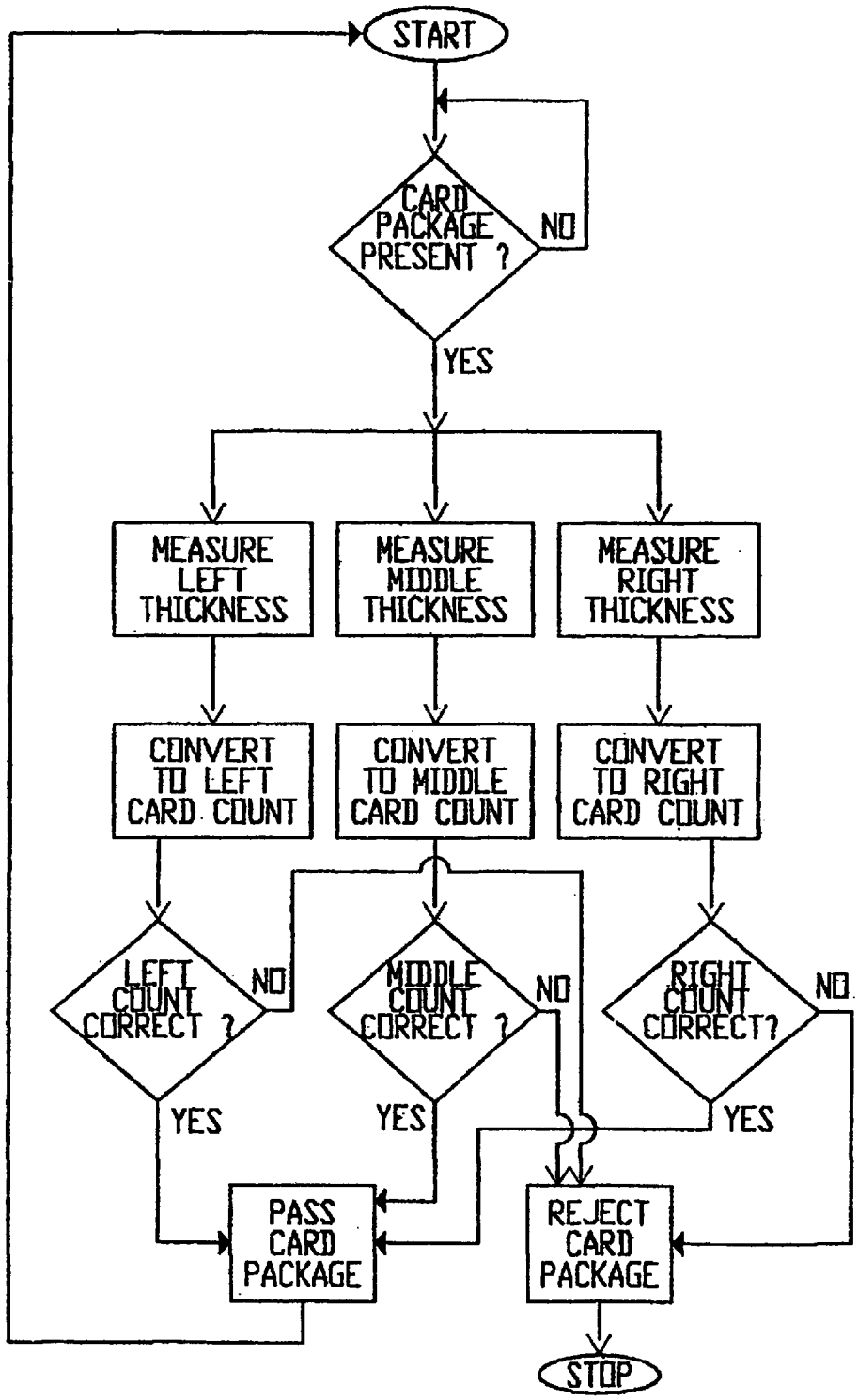

Referring now to FIGS. 51, 52A, B, C, 53, 54, 55, 56, 57, 58, 59A, and B showing the operational routine flow charts of the preferred embodiment. The flow charts are compiled and entered into a software designer program to generate a source code, attached as APPENDIX A, used to control mechanical devices such as the preferred embodiment. The software designer program is called "OPTOCONTROL" manufactured by OPTO 22. Instructions on the use of this software and-the flow chart conventions and protocol can be found in the OPTOCONTROL USER'S GUIDE, Form number 724-990831-August, 1999; the OPTODISPLAY USER'S GUIDE, Form 23-990831-August, 1999; and the OPTOCONTROL COMMAND REFERENCE, Form number 725-990831-August 1999, all of which are hereby incorporated by reference.

What is claimed is:

1. In a card package production system for producing card packages with printed paper carriers with matching cards attached by adhesive to the carriers, the improvement being an adhesive label attachment station, comprising:

a supply of double sided adhesive labels adhered to a roll of backing paper, one side of the labels against the backing paper having a permanent adhesive and the other side facing away from the backing paper having a heat activated adhesive;

a heating platen with a width for heating at least two labels simultaneously;

a label attachment position;

a card transport for moving the cards to the card attachment position;

a label transport system for passing the labels over the platen;

a labeler downstream from the heating platen with a pressing member for pressing a heated adhesive label against a card at the attachment position by pressing against a side of the backing paper opposite the heated adhesive label.

2. The card package production system of claim 1 in which the label pressing member has an eccentric shape and is mounted for rotation into engagement with the backing tape.

3. The card package production system of claim 1 in which the labeler includes a counter member by which the card is held against force from the pressing member.

4. The card package production system of claim 3 in which the counter member is mounted for rocking movement relative to the card.

5. The card package production system of claim 4 in which the counter member is located above the card, and the pressing member presses the adhesive labels upwardly toward the counter member.

6. The card package production system of claim 3 in which the counter member is removeably mounted to a pivot post about which the counter member rocks, said rocking being about an axis parallel to an axis of rotation of the eccentric member.

7. The card package production system of claim 3 in which the card is transported along a track in a horizontal position past the counter member.

8. The card package production system of claim 3 in which the card is transported along a track in a horizontal position past the counter member.

9. The card package production system of claim 8 which the platen is maintained at an average temperature of no less than approximately 100 degrees Fahrenheit and the labels are engaged with the platen for no less than approximately milliseconds.

10. The card package production system claim 9 in which the pressing member presses the label against the card within no less than approximately 100 milliseconds.

11. The card package production system of claim 1 in which the platen is maintained at an average temperature of no less than 210 Fahrenheit degrees and the labels are engaged with the platen for no less than approximately 100 milliseconds.

12. The card package production system of claim 11 in which the pressing member presses the label against the card within no less than approximately 100 milliseconds.

13. In a card package production system for producing card packages with printed paper carriers with matching cards attached by adhesive to the carriers, the improvement being an adhesive label attaching method comprising the steps of:

providing a supply of double sided adhesive labels adhered to a roll of backing paper, one side of the labels against the backing paper having a permanent adhesive and the other side facing away from the backing paper having a heat activated adhesive;

heating at least two labels simultaneously with a heating platen;

moving the cards with a card transport for to a card attachment position;

passing the labels over the platen with a label transport system;

pressing, with a pressing member of a labeler located downstream from the heating platen, a heated adhesive label against a card at the attachment position by pressing against a side of the backing paper opposite the heated adhesive label.

14. The method of claim 13 in which the step of pressing the label includes the step of rotating a label pressing member with an eccentric shape and mounted for rotation into engagement with the backing tape.

15. The method of claim 13 including the step of holding the card against pressing force from the pressing member with a counter member.

16. The method of claim 15 including the step allowing the counter member to engage in rocking movement relative to the card when pressed by the pressing member.

17. The method of claim 16 in which the counter member is located above the card, and including the step of pressing upwardly toward the counter member with the pressing member to press the adhesive labels to.

18. The method of claim 15 including the step of rocking the counter member on a pivot post to which the counter member is removably mounted, said rocking being about an axis parallel to an axis of rotation of the eccentric member.

19. The method of claim 15 in which the card is transported along a track in a horizontal position past the counter member.

20. The method of claim 15 including the step of transporting the card along a track in a horizontal position past the counter member.

21. The method of claim 20 including the steps of maintaining the average temperature of the platen at a minimum level not less than approximately 210 degrees Fahrenheit, and engaging the labels with the platen for no less than approximately 100 milliseconds.

22. The card package production system of claim 15 including the step of pressing with the pressing member the label against the card within no less than approximately 100 milliseconds.

23. The method of claim 13 including the step of maintaining the platen at an average temperature of no less than approximately 210 degrees Fahrenheit, and engaging the labels with the platen for no less than approximately 100 milliseconds.

24. The method of claim 23 in which the pressing member presses the label against the card within no less than approximately 100 milliseconds.

25. In a card package production system for producing card packages with printed paper carriers with matching cards attached to the carriers with adhesive, the improvement being an adhesive label attachment mechanism, comprising:

means for providing double sided adhesive labels on a roll of backing tape to an adhesive label attachment station;

means for heating only an intermediate section of the adhesive to activate a heat activated adhesive carried by an outer side of the adhesive label, leaving end portions of the label relatively unheated and unactivated; and means for pressing the intermediate section of the adhesive to a card after the adhesive has been heated.

26. In a card package production system for producing card packages with printed paper carriers with matching cards attached to the carriers with adhesive, the method of attaching an adhesive label to the card, comprising the steps of:

providing double sided adhesive labels on a roll of backing tape to an adhesive label attachment station;

heating only an intermediate section of the adhesive to activate a heat activated adhesive carried by an outer side of the adhesive label, leaving end portions of the label relatively unheated and unactivated; and pressing the intermediate section of the adhesive to a card after the step of heating only the intermediate section.

* * * * *